US010928758B2

(12) United States Patent
Takano

(10) Patent No.: US 10,928,758 B2
(45) Date of Patent: Feb. 23, 2021

(54) IMAGE FORMING APPARATUS CONTROLLING POWER SUPPLY PATH TO HEATER

(71) Applicant: CANON KABUSHIKI KAISHA, Tokyo (JP)

(72) Inventor: Hiromitsu Takano, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/744,644

(22) Filed: Jan. 16, 2020

(65) Prior Publication Data

US 2020/0233349 A1 Jul. 23, 2020

(30) Foreign Application Priority Data

Jan. 18, 2019 (JP) ..... JP2019-006464

(51) Int. Cl.
*G03G 15/20* (2006.01)

(52) U.S. Cl.
CPC ..... *G03G 15/2042* (2013.01); *G03G 15/2053* (2013.01); *G03G 15/2064* (2013.01); *G03G 2215/2035* (2013.01)

(58) Field of Classification Search
CPC ..... G03G 15/2039; G03G 15/2042; G03G 15/2046; G03G 15/205
See application file for complete search history.

(56) References Cited

U.S. PATENT DOCUMENTS

2007/0201916 A1* 8/2007 Ueno ..... G03G 15/2042 399/334
2016/0018767 A1* 1/2016 Takada ..... G03G 15/206 399/333
2019/0163100 A1* 5/2019 Wakatsu ..... G03G 15/2042

FOREIGN PATENT DOCUMENTS

JP 05-181375 A 7/1993
JP 11161071 A 6/1999
JP 2001-100558 A 4/2001
JP 2013-235181 A 11/2013

* cited by examiner

*Primary Examiner* — Carla J Therrien
(74) *Attorney, Agent, or Firm* — Venable LLP

(57) ABSTRACT

The image forming apparatus includes a fixing apparatus including a heater that includes at least two heat generation members, the fixing unit configured to fix an unfixed toner image formed on a sheet by an image forming unit, a heat generation member switching device configured to switch a power supply path so that electric power can be supplied to one of the heat generation members, a CPU configured to control switching the power supply path by the heat generation member switching device based on a number of shorter width sheets in a longitudinal direction continuously printed in a case where a plurality of mixed sheets including longer width sheets and the shorter width sheets.

18 Claims, 14 Drawing Sheets

IMAGE FORMING APPARATUS CONTROLLING POWER SUPPLY PATH TO HEATER

BACKGROUND OF THE INVENTION

Field of the Invention

The present invention relates to an image forming apparatus for which an electron picture process or the like is used.

Description of the Related Art

An image forming apparatus equipped with a conventional electron picture process includes a heat fixing device. By the heat fixing device, an unfixed image (toner image) that is formed on a transfer sheet by an image forming unit for which an electron picture process is utilized is fixed on the transfer sheet. For the heat fixing device, for example, a heat roller system in which a halogen heater is used as a heat source, a film heating system in which a sheet-shaped ceramic heat generation member heater is used as a heat source, or the like is used. In an image forming apparatus including a fixing apparatus with a sheet-shaped ceramic heat generation member heater as a heat source, the following phenomenon occurs. In a case where the heat generation member has a length supporting a maximum-sheet-feeding width or a length supporting a width of a predetermined sheet size, when a transfer sheet having a sheet-feeding width shorter than the length of the heat generation member (hereinafter, referred to as small size sheet) is conveyed, a temperature of a region being a heat generation region and a non-sheet-feeding region can be higher than a temperature of a sheet-feeding region. Hereinafter, this phenomenon will be referred to as non-sheet-feeding portion temperature rise. Here, the predetermined sheet size is, for example, a standard-size transfer sheet including an A4-sized sheet and a B4-sized sheet, which will be referred to as normal-size sheet. An excessive rise in temperature in the non-sheet-feeding region may cause damage to members around the sheet-shaped ceramic heat generation member heater, such as a member supporting the sheet-shaped ceramic heat generation member heater. A conventional practice to mitigate this impact is to perform throughput down control, in which a throughput of performing image formation on transfer sheets is decreased by detecting or predicting a temperature of an edge portion, or according to a size of a width of the transfer sheet.

To prevent this decrease in throughput, for example, Japanese Patent Application Laid-Open No. 2001-100558 proposes a configuration that includes a plurality of heat generation members having different lengths and switches a heat generation member to supply electric power exclusively with a switch relay, so as to selectively use a heat generation member having a length corresponding to a size of a transfer sheet. By selectively using a heat generation member having a length corresponding to a size of a transfer sheet, the non-sheet-feeding portion temperature rise does not occur, the throughput down control performed to mitigate the non-sheet-feeding portion temperature rise is dispensed with, and thus a high productivity can be provided also for a small size sheet.

In a conventional image forming apparatus, in switching the switch relay, for example, a time of about 200 msec (milliseconds) is needed as a time to physically switch the relay. For that reason, in a case where transfer sheets having different sizes are printed using a heat generation member corresponding to the sizes, it is necessary to provide a switching time between end of fixing processing on a transfer sheet before the switching and start of fixing processing on a transfer sheet after the switching.

In addition, in a case where a switch relay is switched from a heat generation member having a short width in a longitudinal direction to a heat generation member having a long width in the longitudinal direction, a temperature of an edge portion in the longitudinal direction may be significantly decreased as compared with a temperature of a center portion in the longitudinal direction depending on content of print performed thus far. In this case, to ensure fixing properties of the edge portion in the longitudinal direction, it is necessary to provide a switching wait time for the relay, as well as a wait time taken by a temperature of the edge portion in the longitudinal direction to rise to a temperature that allows the edge portion to be fixed. That is, in a case where transfer sheets having different sizes are printed continuously, productivity decreases as compared with a case where transfer sheets having the same size are printed continuously.

SUMMARY OF THE INVENTION

An aspect of the present invention is an image forming apparatus including an image forming unit configured to form a toner image on a recording material, a fixing unit including a heater having at least a first heat generation member and a second heat generation member whose length in a longitudinal direction is shorter than a length of the first heat generation member in the longitudinal direction, the fixing unit configured to fix an unfixed toner image formed on the recording material by the image forming unit, a switch unit configured to switch a power supply path so that electric power is enabled to supply to one of the first heat generation member and the second heat generation member of the heater, and a control unit, in a case where recording materials each having a first width and recording materials each having a second width shorter than the first width in the longitudinal direction are mixedly to be printed, configured to control switching of the power supply path by the switch unit based on a number of the recording materials having the second width to be continuously printed.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Embodiment 1

[Overall Structure]

Figure 1:
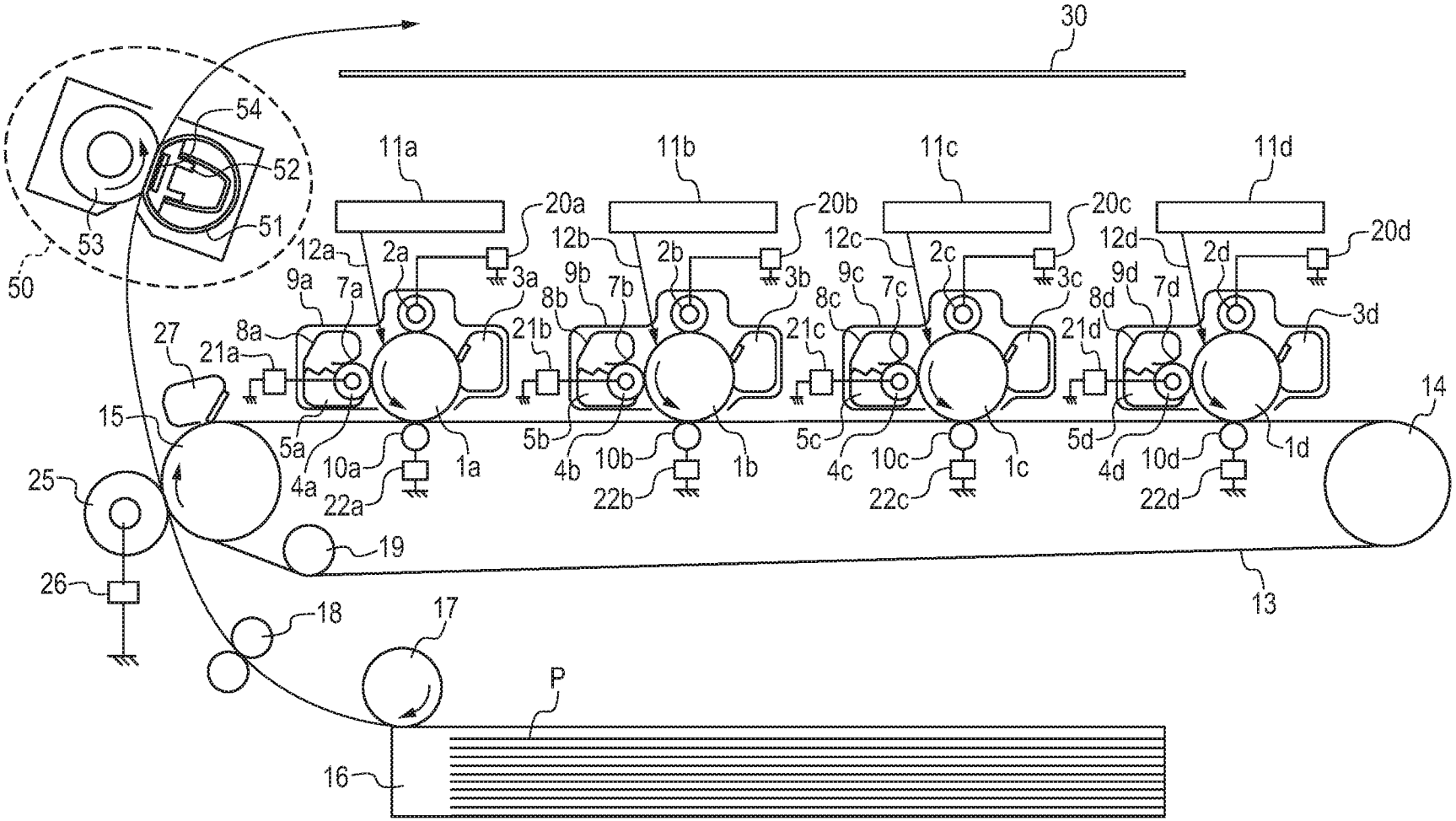
FIG. 1 is a general configuration diagram of an image forming apparatus in Embodiments 1 to 3.

FIG. 1 is a configuration diagram illustrating an in-line color image forming apparatus, which is an example of an image forming apparatus equipped with a fixing apparatus in Embodiment 1. With reference to FIG. 1, operation of an electrophotographic color image forming apparatus will be described. A first station is set as a station for forming a toner image of yellow (Y), and a second station is set as a station for forming a toner image of magenta (M). A third station is set as a station for forming a toner image of cyan (C) is, and a fourth station is set as a station for forming a toner image of black (K).

In the first station, a photosensitive drum 1*a* being an image bearing member is an OPC (organic photoconductor) photosensitive drum. The photosensitive drum 1*a* is made by stacking a plurality of layers of functional organic materials including a carrier generation layer that generates electrical charge when exposed to light, a charge transport layer that transports the generated electrical charge, and the like, on a metallic cylinder, where an outermost layer has such a low electric conductive that the photosensitive drum 1*a* is substantially insulative. A charging roller 2*a* being a charging unit abuts against the photosensitive drum 1*a*, and as the photosensitive drum 1*a* rotates, the charging roller 2*a* follows the rotation to rotate, charging a surface of the photosensitive drum 1*a* uniformly. To the charging roller 2*a*, a DC voltage or a voltage superimposed on an AC voltage is applied, and the photosensitive drum 1*a* is charged by discharge occurring in a minute air gap upstream or downstream of a nip portion formed by the charging roller 2*a* and the surface of the photosensitive drum 1*a* in a rotating direction. A cleaning unit 3*a* is a unit that removes toner left on the photosensitive drum 1*a* after transfer described below. A developing unit 8*a* being a development unit is formed of a developing roller 4*a*, a nonmagnetic one-component toner 5*a*, and a developer application blade 7*a*. The photosensitive drum 1*a*, the charging roller 2*a*, the cleaning unit 3*a*, and the developing unit 8*a* form an integral process cartridge 9*a* that is attachable and detachable with respect to the image forming apparatus.

An exposure device 11*a* being an exposure unit is formed of a scanning unit that scans laser light with a polygon mirror or a light emitting diode (LED) array, and irradiates the photosensitive drum 1*a* with a scanning beam 12*a* modulated based on an image signal. The charging roller 2*a* is connected to a high voltage power supply for charge 20*a*, which is a voltage supply unit for the charging roller 2*a*. The developing roller 4*a* is connected to a high voltage power supply for development 21*a*, which is a voltage supply unit for the developing roller 4*a*. A primary transfer roller 10*a* is connected to a high voltage power supply for primary transfer 22*a*, which is a voltage supply unit for the primary transfer roller 10*a*. The first station has the configuration described above, and the second, third and fourth stations each have the same configuration. In the other stations, components having the same functions as those of the first station will be denoted by the same reference numerals, which are followed by b, c and d as indices for respective stations. In the following description, the indices a, b, c and d will be omitted except for cases where a specific station is described.

An intermediate transfer belt 13 is supported by three rollers, as its tensioning members, including an opposing secondary transfer roller 15, a tension roller 14, and an additional roller 19. The tension roller 14 alone applies a force in a direction of stretching the intermediate transfer belt 13 using a spring, by which the intermediate transfer belt 13 keeps an appropriate force of tension. The opposing secondary transfer roller 15 receives rotary drive from a main motor (not illustrated) to rotate, causing the intermediate transfer belt 13 wound around an outer circumference of the opposing secondary transfer roller 15 to rotate. The intermediate transfer belt 13 moves in a forward direction (e.g., clockwise direction in FIG. 1) as opposed to the photosensitive drums 1*a* to 1*d* (e.g., rotating in a counterclockwise direction in FIG. 1) at a substantially the same speed as that of the photosensitive drums 1*a* to 1*d*. The intermediate transfer belt 13 rotates in an arrow direction (clockwise direction). The primary transfer roller 10 is provided on an opposite side of the intermediate transfer belt 13 to the photosensitive drum 1 and follows the movement of the intermediate transfer belt 13 to rotate. A position at which the photosensitive drum 1 abuts against the primary transfer roller 10 across the intermediate transfer belt 13 is defined a primary transfer position. The additional roller 19, the tension roller 14, and the opposing secondary transfer roller 15 are electrically grounded. In the second to fourth stations, their primary transfer rollers 10*b* to 10*d* each have the same configuration as that of the primary transfer roller 10*a* of the first station and will not be described.

Next, image forming operation of the image forming apparatus in Embodiment 1 will be described. Upon receiving print instructions in a standby state, the image forming apparatus starts the image forming operation. The photosensitive drum 1, the intermediate transfer belt 13, and the like start rotating by their main motors (not illustrated) in the arrow directions at a predetermined process speed. The photosensitive drum 1*a* is uniformly charged by the charging roller 2*a* to which voltage is applied by the high voltage power supply for charge 20*a*, and is subsequently irradiated with the scanning beam 12*a* from the exposure device 11*a*, by which an electrostatic latent image according to image information is formed on the photosensitive drum 1*a*. Toner 5*a* in the developing unit 8*a* is negatively charged by the developer application blade 7*a* and is applied to the developing roller 4*a*. Then, to the developing roller 4*a*, a predetermined development voltage is supplied from the high voltage power supply for development 21*a*.

When the electrostatic latent image formed on the photosensitive drum 1*a* reaches the developing roller 4*a* as the photosensitive drum 1*a* rotates, the electrostatic latent image becomes visible by the negatively charged toner adhered to the electrostatic latent image, and thus a toner image of a first color (e.g., Y (yellow)) is formed on the photosensitive drum 1*a*. The stations of the other colors, M (magenta), C (cyan) and K (black), (process cartridges 9*b* to 9*d*) operate similarly. Electrostatic latent image made by exposure are formed on the photosensitive drum 1*a* to 1*d*, with drawing signals from a controller (not illustrated) being delayed with constant timings based on distances between primary transfer positions of the respective colors. To the respective primary transfer rollers 10*a* to 10*d*, high direct current voltages with a polarity opposite to that of toner are applied. Through the above-described process, toner images are transferred on the intermediate transfer belt 13 one by one (hereinafter, referred to as primary transfer), and a multiplexed toner image is formed on the intermediate transfer belt 13.

Thereafter, in synchronization with the formation of the toner image, a sheet P being one of recording materials loaded in a cassette 16 is fed (picked up) by a feeding roller 17 that is driven to rotate by a sheet feeding solenoid (not illustrated). The fed sheet P is conveyed to registration rollers 18 by a conveyance roller. The sheet P is conveyed to a transfer nip portion by the registration rollers 18 in synchronization with the toner image on the intermediate transfer belt 13, the transfer nip portion is an abutting portion of the intermediate transfer belt 13 and a secondary transfer roller 25. To the secondary transfer roller 25, a voltage with a reversed polarity to that of the toner is applied by the high voltage power supply for secondary transfer 26, which causes the multiplexed toner image of the four colors beard on the intermediate transfer belt 13 to be collectively transferred to the sheet P (recording material) (hereinafter, referred to as secondary transfer). The members that contribute to the formation of an unfixed toner image on the sheet P (e.g., the photosensitive drum 1) function as an image forming unit. After completion of the secondary transfer, toner left on the intermediate transfer belt 13 is removed by the cleaning unit 27. The sheet P after the completion of the secondary transfer is conveyed to a fixing apparatus 50 being a fixing unit, and with the toner image fixed thereto, the sheet P is discharged to a discharge tray 30 as an image formed matter (print, copy). The fixing apparatus 50 includes a film 51, a nip forming member 52, a pressing roller 53, and a heater 54, which will be described below.

[Block Diagram of Image Forming Apparatus]

Figure 2:
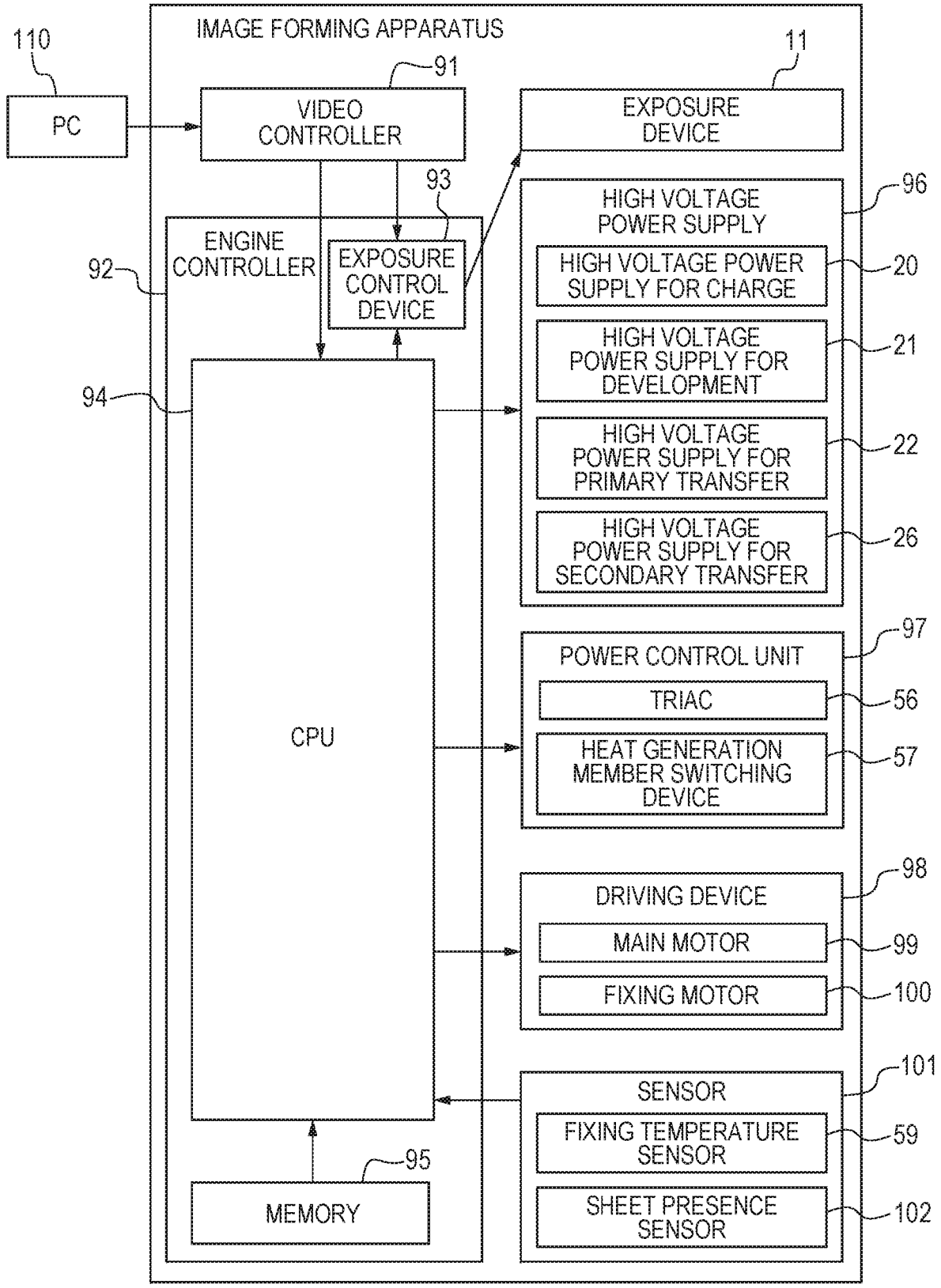
FIG. 2 is a control block diagram of the image forming apparatus in Embodiments 1 to 3.

FIG. 2 is a block diagram used for describing operation of the image forming apparatus. With reference to the drawing, printing operation of the image forming apparatus will be described. A PC 110 being a host computer takes a role of outputting print instructions to a video controller 91 inside the image forming apparatus and transmitting image data on a print image to the video controller 91.

The video controller 91 converts the image data from the PC 110 into exposure data and transmits the exposure data to an exposure control device 93 in an engine controller 92. The exposure control device 93 is controlled by a CPU 94 to control the exposure device 11 according to on/off in the exposure data. Upon receiving the print instructions, the CPU 94 being a control unit starts an image forming sequence.

The engine controller 92 is equipped with the CPU 94, a memory 95, and the like and performs operations that are programmed in advance. A high voltage power supply 96 includes the high voltage power supply for charge 20, the high voltage power supply for development 21, the high voltage power supply for primary transfer 22, and the high voltage power supply for secondary transfer 26, which are previously described. A power control unit 97 includes a bidirectional thyristor (hereinafter, referred to as triac) 56, a heat generation member switching device 57 as a switch unit that exclusively selects a heat generation member to which electric power is to be supplied. The heat generation member switching device 57 switches a power supply path so that electric power can be supplied to one of the heat generation member 54*b*1 and the heat generation member 54*b*2 of the heater 54. In the following description, the switching of the electric power supply path to supply electric power to one of the heat generation member 54*b*1 and the heat generation member 54*b*2 by the heat generation member switching device 57 will be simply expressed as switching to the heat generation member 54*b*1 or the heat generation member 54*b*2. The power control unit 97 selects a heat generation member that is to generate heat in the fixing apparatus 50 and determines an electric energy to supply. A driving device 98 includes a main motor 99, a fixing motor 100, and the like. A sensor 101 includes a fixing temperature sensor 59 that detects a temperature of the fixing apparatus 50, sheet presence sensors 102 each of which has a flag and detects presence/absence of a sheet P, and the like, and detection results from the sensor 101 are sent to the CPU 94. The CPU 94 acquires the detection results from the sensor 101 in the image forming apparatus and controls the exposure device 11, the high voltage power supply 96, the power control unit 97, and the driving device 98. By forming an electrostatic latent image, transferring a developed toner image, fixing the toner image to a sheet P, and the like with these components, the CPU 94 controls an image forming process in which exposure data is printed on the sheet P in a form of the toner image. The image forming apparatus to which the present invention is applied is not limited to the image forming apparatus having the configuration described with reference to FIG. 1 and is any image forming apparatus that is capable of printing sheets P of different widths and includes the fixing apparatus 50 having the heater 54 described below.

[Fixing Apparatus]

Figure 3:
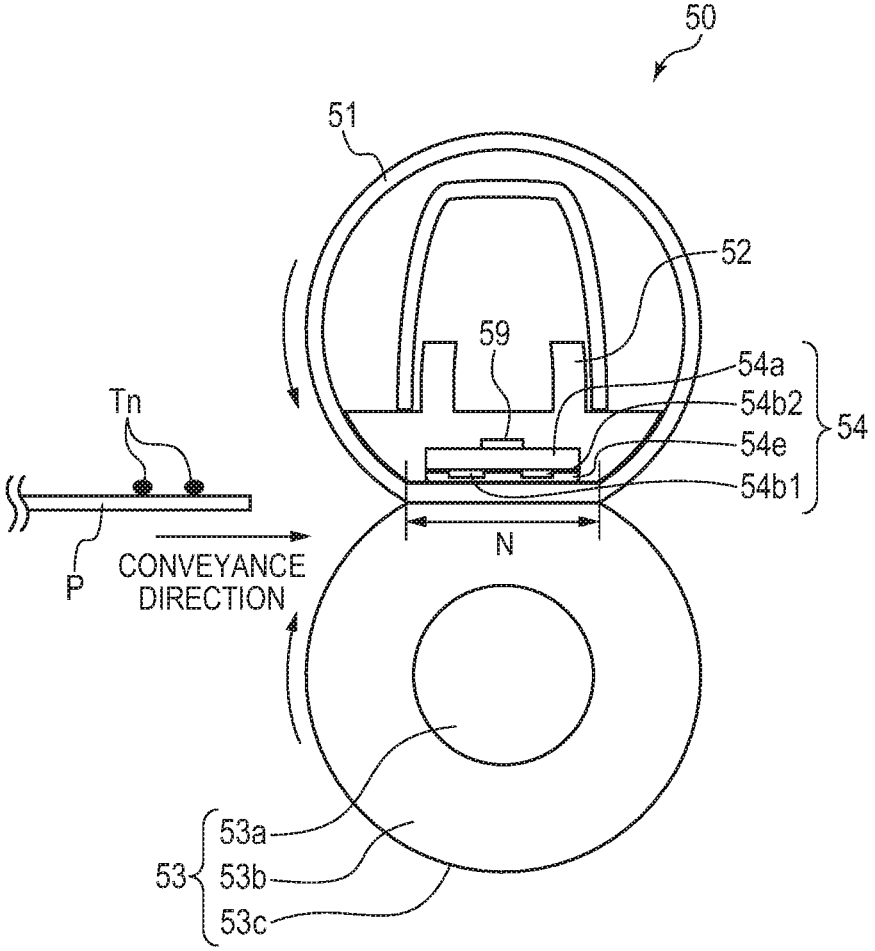
FIG. 3 is a cross-sectional schematic diagram of a fixing apparatus in Embodiments 1 to 3, illustrating a vicinity of a center portion of the fixing apparatus in its longitudinal direction.
Figure 4A:
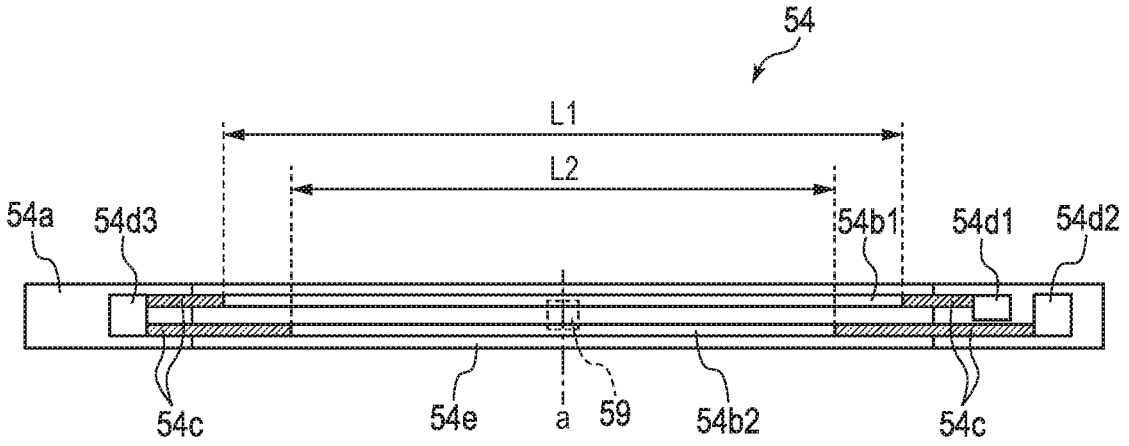
FIG. 4A is a schematic diagram of a heater in Embodiments 1 to 3.
Figure 4B:
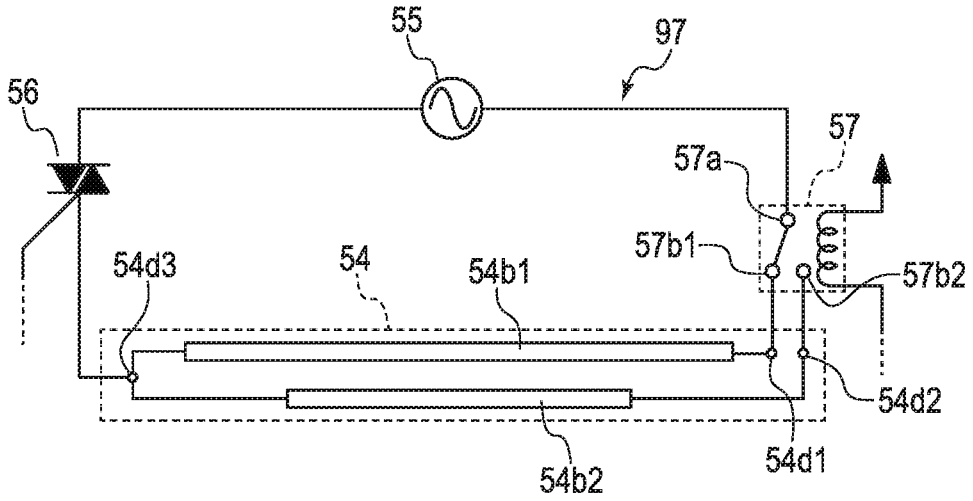
FIG. 4B is a schematic diagram of a power control circuit of the fixing apparatus in Embodiments 1 to 3.

Next, a configuration of the fixing apparatus 50 in Embodiment 1 will be described with reference to FIG. 3, FIG. 4A and FIG. 4B. Here, a longitudinal direction refers to a rotation axis direction of the pressing roller 53 that is substantially perpendicular to the conveyance direction of a sheet P described below. In addition, a width refers to a length of a sheet P in a direction that is substantially perpendicular to the conveyance direction (longitudinal direction). FIG. 3 is a cross-sectional schematic diagram of the fixing apparatus 50, FIG. 4A is a schematic diagram of the heater 54, and FIG. 4B is a circuit schematic diagram of the power control unit 97.

A sheet P bearing an unfixed toner image Tn is conveyed from the left of FIG. 3 into a fixing nip portion N from the left to the right of the drawing to be heated, by which the toner image Tn is fixed to the sheet P. The fixing apparatus 50 in Embodiment 1 includes the cylindrical film 51, the nip forming member 52 that retains the film 51, the pressing roller 53 that forms the fixing nip portion N together with the film 51, and the heater 54 that heats a sheet P.

The film 51 being a first rotary member is a fixing film as a heating rotary member. In Embodiment 1, for the base layer, polyimide is used, for example. On the base layer, the elastic layer made of silicone rubber and the release layer made of PFA are used. To an inner surface of the film 51, grease is applied to reduce frictional force that occurs between the film 51, and the nip forming member 52 and the heater 54 due to rotation of the film 51.

The nip forming member 52 takes a role of guiding the film 51 on an inner side of the film 51, as well as forming the fixing nip portion N with the pressing roller 53 across the film 51. The nip forming member 52 is a member having rigidity, heat-resistant properties, and heat-insulation properties, and is formed of liquid crystal polymer, or the like. The film 51 is fitted over this nip forming member 52. The pressing roller 53 being a second rotary member is a roller as a pressing rotary member. The pressing roller 53 includes a core 53*a*, an elastic layer 53*b*, and a release layer 53*c*. The pressing roller 53 is held rotatably at its both ends and is driven to rotate by the fixing motor 100 (see FIG. 2). As the pressing roller 53 rotates, the film 51 follows the rotation to rotate. The heater 54 being a heating member is held by the nip forming member 52 and is in contact with the inner surface of the film 51. The heater 54 is provided to be in contact with an internal surface of the film 51, and a fixing nip portion N is formed of the heater 54 and the pressing roller 53 across the film 51. A substrate 54*a*, heat generation members 54*b*1 and 54*b*2, a protection glass layer 54*e*, and a fixing temperature sensor 59 will be described below.

(Heater)

The heater 54 will be described in detail with reference to FIG. 3 and FIG. 4A. The heater 54 includes the substrate 54*a*, the heat generation members 54*b*1 and 54*b*2, conductors 54*c*, contacts 54*d*1 to 54*d*3, and the protection glass layer 54*e*. On the substrate 54*a*, the heat generation members 54*b*1 and 54*b*2, the conductors 54*c*, and the contacts 54*d*1 to 54*d*3 are formed, on which the protection glass layer 54*e* is formed to secure insulation between the heat generation members 54*b*1 and 54*b*2, and the film 51. The heat generation member 54*b*1 being a first heat generation member has a length in the longitudinal direction (hereinafter, referred to also as size) different from that of the heat generation member 54*b*2 being a second heat generation member. Specifically, the length in the longitudinal direction of the heat generation member 54*b*1 is L1, the length in the longitudinal direction of the heat generation member 54*b*2 is L2, and the length L1 and the length L2 satisfy a relation of L1>L2. The length L1 of the heat generation member 54*b*1 is set at a length that enables a sheet P having a largest width of sheets P that can be printed (or conveyed) by this image forming apparatus (hereinafter, referred to as maximum-sheet-feeding width) to be subjected to fixing. Hereinafter, a sheet P having the length L1 being a recording material having a first width will be referred to as an L1-width sheet P, and a sheet P having the length L2 being a recording material having a second width will be referred to as an L2-width sheet P. The heat generation member 54*b*1 is electrically connected to the contacts 54*d*1 and 54*d*3 via the conductors 54*c*, and the heat generation member 54*b*2 is electrically connected to the contacts 54*d*2 and 54*d*3 via the conductors 54*c*. That is, the contact 54*d*3 is a contact that is connected to the heat generation members 54*b*1 and 54*b*2 in common.

The fixing temperature sensor 59 is positioned on an opposite surface of the substrate 54*a* to the protection glass layer 54*e*, is provided at a center position a of the heat generation members 54*b*1 and 54*b*2 in the longitudinal direction, and is in contact with the substrate 54*a*. The fixing temperature sensor 59 is, for example, a thermistor, detects a temperature of the heater 54, and outputs a detection result to the CPU 94. Based on the detection result from the fixing temperature sensor 59, the CPU 94 controls the temperature in fixing processing.

(Power Control Unit)

FIG. 4B is a schematic diagram of the power control unit 97 being a control circuit for the fixing apparatus 50. The power control unit 97 for the fixing apparatus 50 includes the heat generation members 54*b*1 and 54*b*2 (the heater 54), an AC power supply 55, the triac 56, and the heat generation member switching device 57. The triac 56 is brought into conduction to supply electric power from the AC power supply 55 to the heat generation members 54*b*1 and 54*b*2, and is brought out of conduction to cut off the supply of the electric power from the AC power supply 55 to the heat generation members 54*b*1 and 54*b*2. The triac 56 functions as a connecting unit that connects and cuts off the supply of the electric power to the heater 54. Based on temperature information, the detection result from the fixing temperature sensor 59, the CPU 94 calculates an electric power necessary to control the heat generation members 54*b*1 and 54*b*2 to a target temperature and performs control to bring the triac 56 into or out of conduction.

The heat generation member switching device 57 is, for example, a C contact relay in Embodiment 1. Specifically, the heat generation member switching device 57 includes a contact 57*a* connected to the AC power supply 55, a contact 57*b*1 connected to the contact 54*d*1, and a contact 57*b*2 connected to the contact 54*d*2. The heat generation member switching device 57 assumes one of a state where the contact 57*a* is connected to the contact 57*b*1 and a state where the contact 57*a* is connected to the contact 57*b*2, under control by the CPU 94. Switching of the heat generation member switching device 57 causes exclusive selection of whether to supply electric power to the heat generation member 54*b*1 or the 54*b*2. That is, the heat generation member switching device 57 switches the heater 54 to one of the heat generation member 54*b*1 and the heat generation member 54*b*2. The heat generation member switching device 57 performs the switching upon receiving a signal from the CPU 94. To prevent from the contacts from fusing in the heat generation member switching device 57 being a C contact relay, the switching of the heat generation member switching device 57 is performed in a state where the triac 56 is out of conduction (state where power supply to the heat generation member 54*b*1 or the heat generation member 54*b*2 is cut off).

In Embodiment 1, the heater 54 is connected to the heat generation member 54*b*1 by the heat generation member switching device 57, in an initial state. Here, the initial state refers to a time when electric power is not supplied to the heater 54 via the heat generation member switching device 57, such as a state where a switch provided in a main body of the image forming apparatus (hereinafter, referred to as main body switch) (not illustrated) is off, and also includes a state before the print is started. That is, the heat generation member switching device 57 is in a state where the contact 57*a* is connected to the contact 57*b*1. For that reason, when one job is ended, the CPU 94 is to control the heater 54 into a state where the heater 54 is connected to the heat generation member 54*b*1 by the heat generation member switching device 57. Having such a configuration dispenses with a downtime for switching even in a case printing instructions are issued to the image forming apparatus from a state where electric power is not supplied to heat generation member switching device 57 such as a time when the main body switch is off. In Embodiment 1, it is assumed that a time taken from when the CPU 94 outputs a signal for the switching to the heat generation member switching device 57 until the switching of the heat generation member switching device 57 is actually performed is, for example, 0.2 seconds.

[Case Where Number of L2-Width Sheets is Large] (Without Switching)

Next, referring to FIG. 5A to FIG. 5F and FIG. 6A to FIG. 6F, advantages of the configuration the image forming apparatus in Embodiment 1, which is described with reference to FIG. 1 to FIG. 4B, will be described. FIG. 5A to FIG. 5F are diagrams of performing print using only the heat generation member 54*b*1 without the switching of the heat generation member switching device 57 in the previously-described configuration. FIG. 5A to FIG. 5F are diagrams of a case where sheets P of different widths are mixed in one job, such as a case where, seven sheets are printed in an order of an L1-width sheet α1, L2-width sheets β1 to β5, and an L1-width sheet α2. The L1-width sheets α1 and α2 may be collectively referred to as sheets α, and the L2-width sheets β1 to β5 may be collectively referred to as sheets β. The sheets α have a width corresponding to the length of the heat generation member 54*b*1 (L1), and the sheet β have a width corresponding to the length of the heat generation member 54*b*2 (L2).

Figures 5A, 5B, 5C, 5D, 5E, 5F:
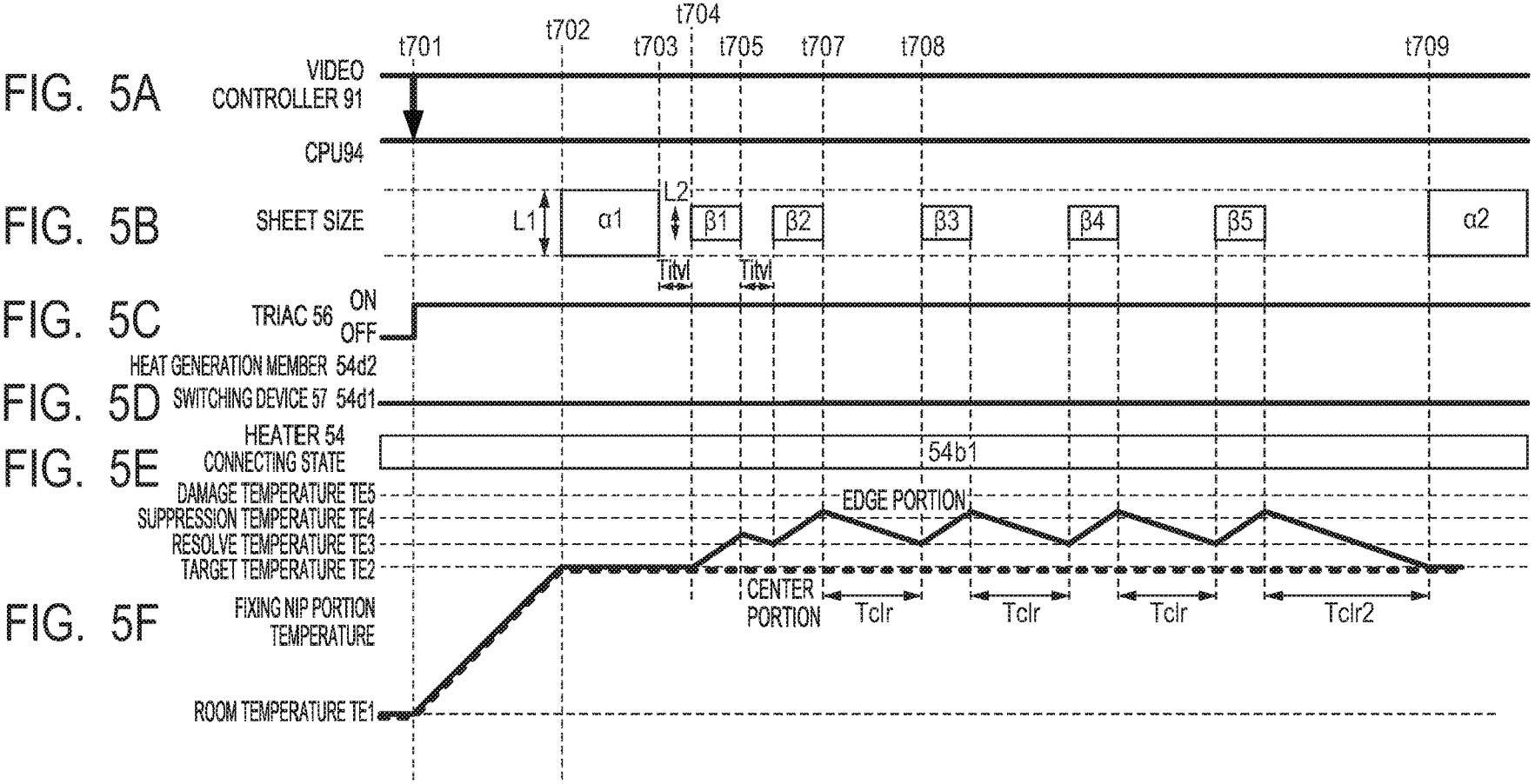
FIGS. 5A, 5B, 5C, 5D, 5E and. 5F are timing diagrams illustrating operation by the image forming apparatus in Embodiment 1.

FIG. 5A illustrates transmission/reception of printing instructions between the video controller 91 and the CPU 94, and FIG. 5B illustrates sizes in the longitudinal direction (L1, L2, etc.) of the sheets P to be printed. FIG. 5C illustrates a conduction state or a non-conduction state of the triac 56 as ON (high-level) or OFF (low-level). FIG. 5D illustrates which of the contact 54*d*1 and the contact 54*d*2 is connected by the switching of the heat generation member switching device 57. FIG. 5E illustrates a connection state of the heater 54. For example, "54*b*1" indicates that the heat generation member 54*b*1 is connected. FIG. 5F indicates a temperature of the fixing nip portion N, where a solid line indicates a temperature of the edge portion described below, and a broken line indicates a temperature of a center portion described below. In FIG. 5F, let a room temperature be denoted by TE1, a target temperature of the heater 54 be denoted by TE2, a resolve temperature be denoted by TE3, a suppression temperature be denoted by TE4, and a damage temperature be denoted by TE5. The resolve temperature TE3, the suppression temperature TE4, and the damage temperature TE5 will be described below. These temperatures establishes a relation of TE1<TE2<TE3<TE4<TE5. In these diagrams, their horizontal axes represent time.

In the heat generation member switching device 57 in a state before the printing instructions are received, the contact 57*a* and the contact 57*b*1 are connected to each other, and the contact 54*d*1 and the heat generation member 54*b*1 are connected to each other. Upon receiving, from the video controller 91, printing instructions indicating that seven sheets are to be printed in an order of the L1-width sheet α1, the L2-width sheets β1 to β5, and the L1-width sheet α2, the CPU 94 brings the triac 56 into the conduction state (ON) (t701). When the triac 56 is turned on, the temperature of the fixing nip portion N rises in both the edge portion and the center portion (FIG. 5F). The CPU 94 performs sheet feeding operation on the sheet α1 based on a detection result from the fixing temperature sensor 59 such that the sheet α1 reaches the fixing nip portion N at a timing when the temperature of the fixing nip portion N reaches the target temperature TE2. The sheet α1 is thereby fed and conveyed and then enters the fixing nip portion N at the target temperature TE2 (t702). The sheet α1 is then fixed at target temperature TE2 from its leading edge to its trailing edge and passes the fixing nip portion N (t703).

At the same time, the CPU 94 performs the sheet feeding operation such that a distance between the trailing edge of the sheet α1 and a leading edge of the sheet β1 (hereinafter, referred to as sheet interval) becomes a sheet interval that is a minimum for various sensors to detect the sheet interval (hereinafter, referred to as minimum sheet interval). When the sheet β1 is conveyed at a predetermined carry speed such that the minimum sheet interval is provided, a value of time into which the minimum sheet interval is converted will be denoted by a time Titv1. The sheet β1 is thereby fed and conveyed and then enters the fixing nip portion N in a state where the heat generation member 54*b*1 is at the target temperature TE2 (t704). The sheet β1 then fixed at target temperature TE2 to its trailing edge and passes the fixing nip portion N (t705).

At that time, a temperature of the fixing nip portion N inner than the width L2 of the sheet β1 (hereinafter, referred to as center portion) is controlled by the CPU 94 to be the target temperature while heat of the center portion is absorbed by the sheet β1. In contrast, a temperature of the fixing nip portion N outer than the width L2 of the sheet β1 (hereinafter, referred to as edge portion) becomes higher than the temperature of the center portion because heat of the edge portion is not absorbed by the sheet β1. Hereinafter, this phenomenon will be referred to as edge portion temperature rise. If the temperature of the edge portion of the fixing nip portion N rises to not less than a predetermined temperature (hereinafter, referred to as damage temperature TE5), there is a risk that the fixing apparatus 50 becomes damaged.

Hence, in a case where the print is performed using only heat generation member 54*b*1 without the switching of the heat generation member switching device 57, when the CPU 94 determines that the fixing apparatus 50 may become damaged, the CPU 94 performs control to extends the sheet interval to decrease a throughput. With this control, the CPU 94 prevents the fixing apparatus 50 from becoming damaged.

The determination as to whether the fixing apparatus 50 becomes damaged is performed based on whether the temperature of the fixing nip portion N has reached a predetermined temperature (hereinafter, referred to as suppression temperature TE4) at which it is determined that the damage temperature TE5 is reached if the temperature control is further continued. In a case where the temperature of the fixing nip portion N reaches the suppression temperature TE4, the CPU 94 performs the following control. That is, the CPU 94 performs control so as not to perform fixing processing on a sheet P until the temperature of the fixing nip portion N reaches a predetermined temperature (hereinafter, referred to as resolve temperature TE3) at which it is determined that the damage temperature TE5 is not reached immediately.

Return to the description of FIG. 5A to FIG. 5F. For some time since the fixing processing on the sheet β1 is started, the temperature of the edge portion of the fixing nip portion N rises but does not reach the suppression temperature TE4 (FIG. 5F). Therefore, the fixing processing can be performed with the minimum sheet interval until, for example, the sheet α2. However, the temperature of the edge portion of the fixing nip portion N eventually reaches the suppression temperature TE4, arising the need of decreasing the throughput. In the case illustrated in FIG. 5A to FIG. 5F, the temperature of the edge portion of the fixing nip portion N has not reached the suppression temperature TE4 at a time when the sheet β1 is fixed. Therefore, also the sheet β2 can be fixed with the minimum sheet interval as with the sheet β1, by which an optimum throughput can be provided. However, at a timing when the fixing of the sheet β2 is ended, the temperature of the edge portion of the fixing nip portion N reaches the suppression temperature TE4 (t707). Therefore, the CPU 94 performs control to wait for a time Tclr during which the temperature of the edge portion of the fixing nip portion N to decrease to the resolve temperature TE3 before the sheet β3 enters the fixing nip portion N (t708). Thereafter, also for the sheets β4 and β5, the temperature of the edge portion of the fixing nip portion N reaches the suppression temperature TE4. Therefore, the CPU 94 performs the fixing processing on the sheets β while extending the sheet interval, that is, waiting for the time Tclr, as with the sheet β3.

After the printing with the decreased throughput is performed in this manner, and the fixing processing up to the sheet β5 is ended, the print on the sheet α2 is then performed. For the sheet α2, it is necessary to consider not only the time Tclr previously described during which the temperature of the edge portion of the fixing nip portion N to decrease to the resolve temperature TE3 but also the time Tclr2 during which a temperature difference between the center portion and the edge portion of the fixing nip portion N is resolved. This is because the temperature difference between the center portion and the edge portion causes a difference in fixing properties of the sheet α2 having passed the fixing apparatus 50, which arises a risk that image unevenness occurs. That is, at a time of the fixing processing, the temperature of the fixing nip portion N has to be at the target temperature TE2 in its center portion and the edge portion regarding to the width L1 of the sheet α2. Therefore, the CPU 94 performs control to wait for a time Tclr2 during which the temperature difference between the center portion and the edge portion of the fixing nip portion N is resolved before the sheet α2 enters the fixing nip portion N (t709). Thus, the time Tclr2 is longer than the time Tclr (Tclr2>Tclr).

As seen from the above, in the case where heating processing is performed on the L2-width sheets P (sheets β1 to β5 previously described) using only the heat generation member 54*b*1 without the switching of the heat generation member switching device 57, the edge portion temperature rise occurs. In addition, in a case where a degree of the edge portion temperature rise becomes not less than a predetermined degree, for example, in a case where the temperature of the fixing nip portion N becomes not less than the suppression temperature TE4, it is necessary to extend the sheet interval to decrease the throughput for resolving the edge portion temperature rise.

(With Switching)

Next, FIG. 6A to FIG. 6F are diagrams of performing print while switching the heat generation member switching device 57 to use the heater 54 corresponding to a sheet size with the configuration described with reference to FIG. 1 to FIG. 4B. FIG. 6A to FIG. 6F illustrates graphs similar to the graphs of the FIG. 5A to FIG. 5F. FIG. 6A to FIG. 6F are diagrams of a case where sheets P of different widths are mixed in one job, such as a case where, seven sheets are printed in an order of an L1-width sheet α1, L2-width sheets β1 to β5, and an L1-width sheet α2. In this case, the heater 54 is switched between the sheet α1 and the sheet β1, and between the sheet β5 and the sheet α2. The CPU 94 uses the triac 56 to cut off the supply of electric power to the heater 54 before the heater 54 is switched by the heat generation member switching device 57, and uses the triac 56 to connect the supply of electric power to the heater 54 after the heater 54 is switched by the heat generation member switching device 57. For the description, matters overlapping those of FIG. 5A to FIG. 5F will not be described.

Figures 6A, 6B, 6C, 6D, 6E, 6F:
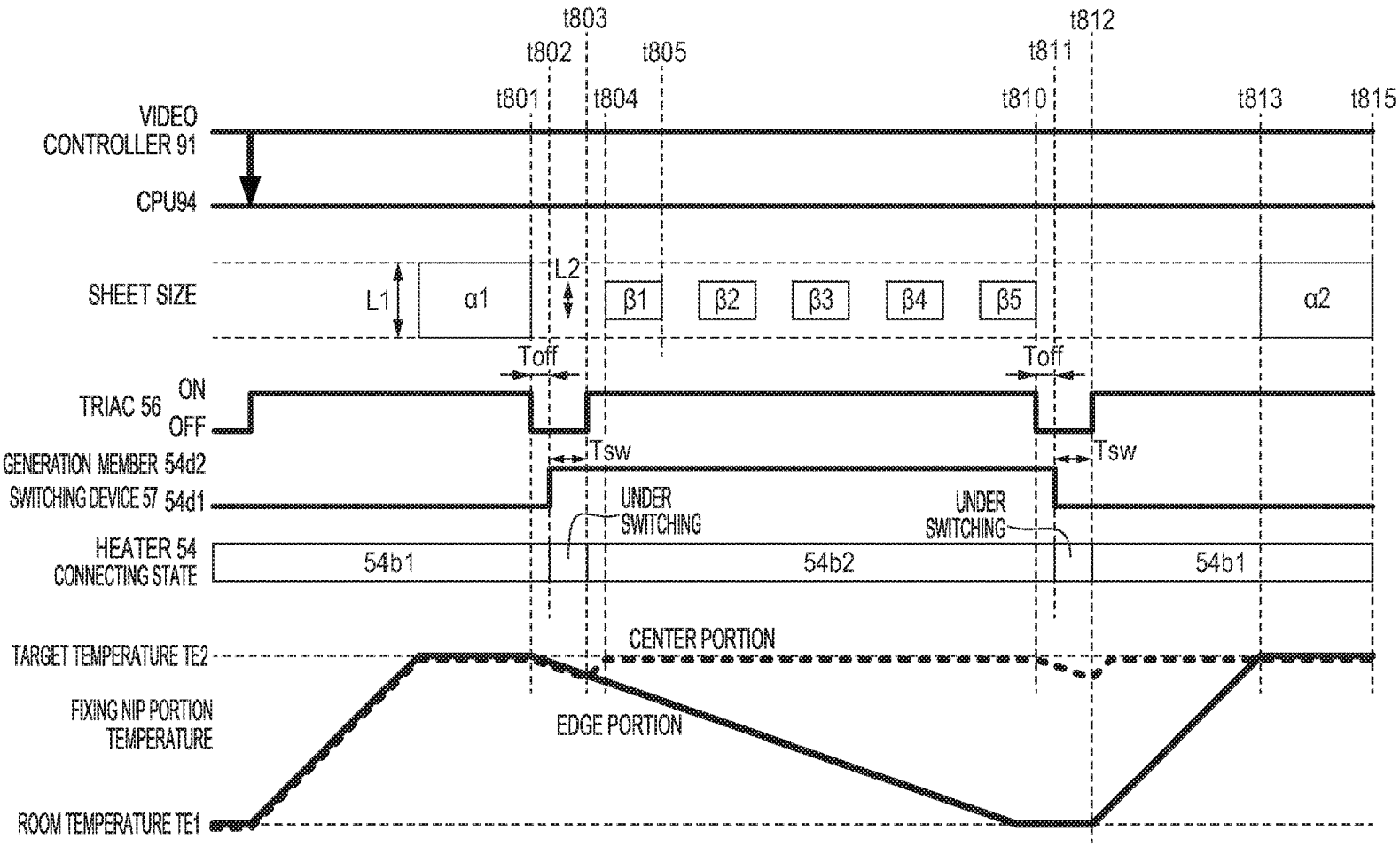
FIGS. 6A, 6B. 6C, 6D, 6E and 6F are timing diagrams illustrating operation by the image forming apparatus in Embodiment 1.
Figures 7A, 7B, 7C, 7D, 7E, 7F:
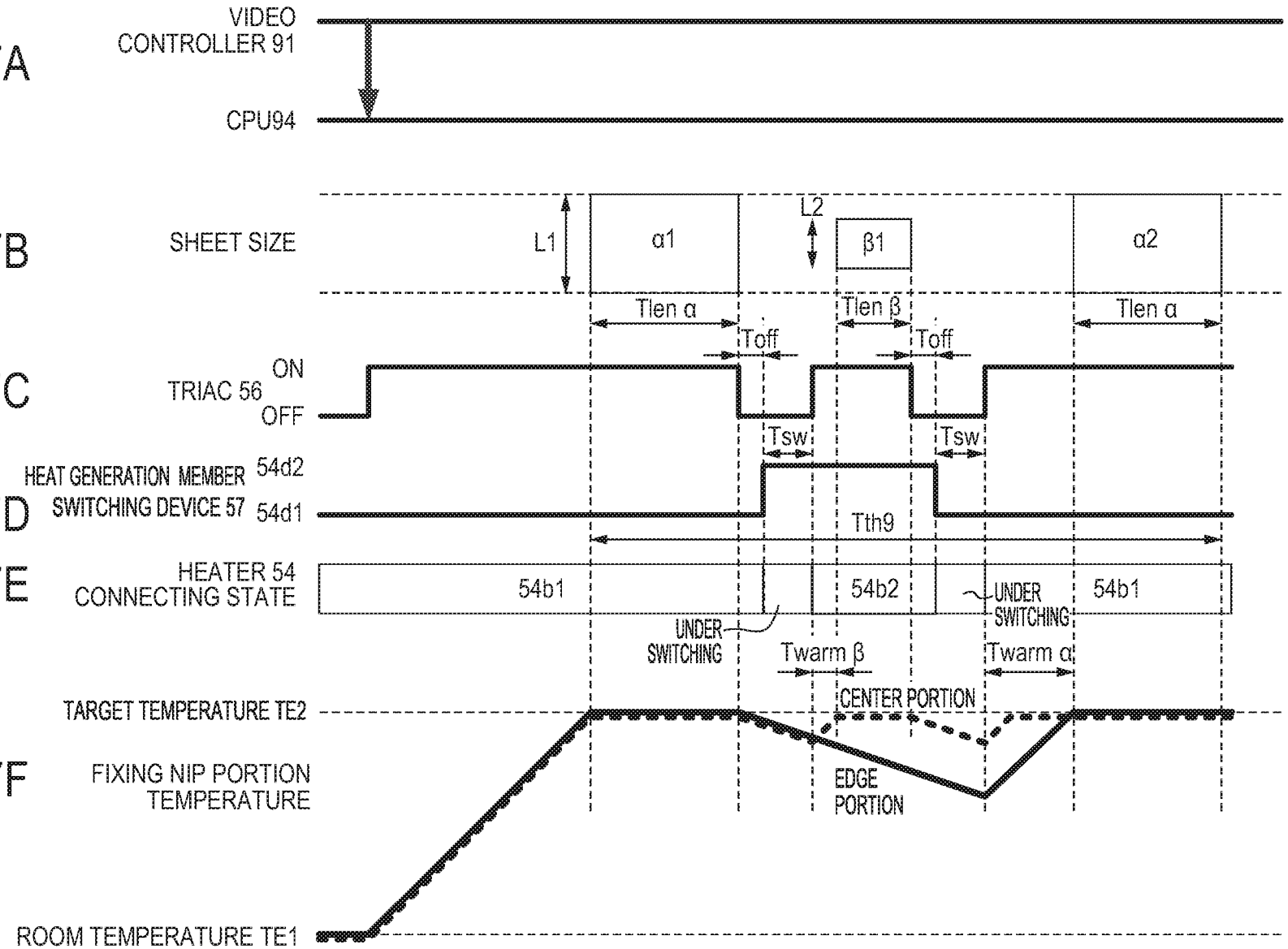
FIGS. 7A, 7B, 7C, 7D, 7E and 7F are timing diagrams illustrating operation by the image forming apparatus in Embodiment 1.

Operation from feeding and conveying the sheet α1 to fixing and feeding the sheet α1 at the target temperature TE2 is the same as that illustrated in FIG. 5A to FIG. 5F. In this case, at a timing when the trailing edge of the sheet α1 passes through the fixing nip portion N, the CPU 94 turns off the triac 56 to switch the heater 54 from the heat generation member 54*b*1 to the heat generation member 54*b*2 (t801) (FIG. 6C). This causes the temperature of the fixing nip portion N to start decreasing in both the edge portion and the center portion (FIG. 6D).

From when the CPU 94 starts control to turn off the triac 56 at a timing t801 until when the triac 56 is turned off, a time Toff elapses. At a timing t802 at which the triac 56 is reliably turned off, the CPU 94 switches a signal to the heat generation member switching device 57 so that the contact 54*d*2 is connected by the heat generation member switching device 57 (FIG. 5D). The heat generation member switching device 57 then starts switching the contact, switching from a state where the contact 57*a* is connected to the contact 57*b*1 to a state where the contact 57*a* is connected to the contact 57*b*2. The heat generation member switching device 57 completes the switching of the contact until a time Tsw elapses from the timing t802 (FIG. 6E) (under switching). The CPU 94 waits for the time Tsw from the timing t802 and turns on the triac 56 again to fix the next sheet β1 (t803) (FIG. 6C).

In a state where the contact 54*d*2 is connected by the heat generation member switching device 57, the heat generation member 54*b*2 having a width shorter than that of the heat generation member 54*b*1 generates heat. Thus, the center portion of the fixing nip portion N is heated, and the temperature of the center portion rises (FIG. 6D). In contrast, the edge portion of the fixing nip portion N is not heated and is further decreased in temperature by natural radiation (FIG. 6D). The CPU 94 performs sheet feeding operation on the sheet β1 such that the sheet β1 reaches the fixing nip portion N at a timing when the temperature of the center portion of the fixing nip portion N reaches the target temperature TE2. The sheet β1 is thereby fed and conveyed and then enters the fixing nip portion N in a state where the fixing nip portion N is at the target temperature TE2 (t804). The sheet β1 then fixed at target temperature TE2 to its trailing edge and passes the fixing nip portion N (t805). At that time, since the edge portion temperature rise does not occur as previously described, the sheet β2 subsequent to the sheet β1 can be fixed with the minimum sheet interval, by which an optimum throughput can be provided. Therefore, also the subsequent sheets β3 to β5 can be fixed with the minimum sheet interval, by which an optimum throughput can be provided.

At a timing when the trailing edge of the sheet β5 passes through the fixing nip portion N, the CPU 94 turns off the triac 56 to switch the heater 54 from the heat generation member 54*b*2 to the heat generation member 54*b*1 (t810) (FIG. 6C). This causes the temperature of the fixing nip portion N to start decreasing (FIG. 6F). The time Toff elapses from the timing t810, and at a timing t811 at which the triac 56 is reliably turned off, the CPU 94 switches a signal to the heat generation member switching device 57 so that the contact 54*d*1 is connected by the heat generation member switching device 57 (FIG. 6D). The heat generation member switching device 57 then starts switching the contact, switching from the state where the contact 57*a* is connected to the contact 57*b*2 to the state where the contact 57*a* is connected to the contact 57*b*1. The heat generation member switching device 57 completes the switching of the contact until the time Tsw elapses from the timing t811. The CPU 94 waits for the time Tsw from the timing t811 and turns on the triac 56 again to fix the next sheet α2 (t812) (FIG. 6C).

In a state where the contact 54*d*1 is connected by the heat generation member switching device 57, the heat generation member 54*b*1 having the width longer than that of the heat generation member 54*b*2 generates heat. Thus, the temperature of the fixing nip portion N rises in both the edge portion and the center portion (FIG. 6F). Thereafter, the temperature of the center portion of the fixing nip portion N shortly reaches the target temperature TE2, whereas the edge portion, which is subjected to natural radiation during the print of the sheets β1 to β5, takes a time longer than a time taken by the center portion to reach the target temperature TE2. If the sheet α2 enters the fixing apparatus 50 without waiting for the time, the sheet α2 enters the fixing apparatus 50 in a state where the temperature of the edge portion of the fixing nip portion N is lower than the target temperature TE2. Then, an edge portion of the sheet α2 suffers poor fixing. Therefore, it is necessary to wait the time during which the temperature of the edge portion of the fixing nip portion N reaches the target temperature TE2.

The CPU 94 performs sheet feeding operation on the sheet α2 such that the sheet α2 reaches the fixing nip portion N at a timing when the temperature of the edge portion of the fixing nip portion N reaches the target temperature TE2. The sheet α2 is thereby fed and conveyed and then enters the fixing nip portion N in a state where the fixing nip portion N is at the target temperature TE2 in both the center portion and the edge portion (t813) (FIG. 6F). The sheet α2 is then fixed at target temperature TE2 to its trailing edge and passes the fixing nip portion N (t815).

As described above with reference to FIG. 6A to FIG. 6F, in a case where the heat generation member switching device 57 is switched, the time for the switching and the time taken by the decreased temperature of the edge portion of the fixing nip portion N to reach the target temperature TE2 are needed. However, by switching the heat generation member switching device 57, the edge portion temperature rise does not occur even during heating the L2-width sheets β1 to β5, which has an advantage of dispensing with extending the sheet interval to resolve the edge portion temperature rise, enabling the print to be performed with the minimum sheet interval. In addition, this advantage becomes a strong advantage because a number of sheets fixed with the minimum sheet interval increases as a number of the L2-width sheets β increases.

[Case Where Number of L2-Width Sheets is Small]

In contrast, in a case where a number of L2-width sheets β is small, the time for switching the heater 54 becomes prominent, not switching the heat generation member switching device 57 can provide a throughput higher than a throughput provided when the heat generation member switching device 57 is switched. This will be described with reference to FIG. 7A to FIG. 7F and FIG. 8A to FIG. 8F. FIG. 7A to FIG. 7F and FIG. 8A to FIG. 8F are both diagrams illustrating a case where sheets P of different widths are mixed in one job, such as a case where, three sheets are printed in an order of an L1-width sheet α1, an L2-width sheet β1, and an L1-width sheet α2. FIG. 7A to FIG. 7F and FIG. 8A to FIG. 8F are graphs similar to the graphs of the FIG. 5A to FIG. 5F. FIG. 7A to FIG. 7F are graphs of a case where the heat generation member switching device 57 is switched, and FIG. 8A to FIG. 8F are graphs of a case where the heat generation member switching device 57 is not switched.

(With Switching)

First, FIG. 7A to FIG. 7F will be described. In FIG. 7A to FIG. 7F, operation from feeding and conveying the sheet β1 and fixing the sheet β1 at the target temperature TE2 is the same as that illustrated in FIG. 6A to FIG. 6F. Operation after fixing the sheet β1 at the target temperature TE2 is the same as operation after fixing the sheet β5 at the target temperature TE2 described with reference to FIG. 6A to FIG. 6F. In FIG. 7A to FIG. 7F, a time Tth9 from when a leading edge of the sheet α1 enters the fixing nip portion N until when a trailing edge of the sheet α2 passes through the fixing nip portion N is calculated by the following Formula (1).

To calculate the time Tth9, a conveyance time Tlenα of the sheets α1 and α2, a conveyance time Tlenβ of the sheet β1, the time Toff taken by the triac 56 to be turned off, and the time Tsw taken by the contact to be switched are used as parameters. In addition, a time Twarmβ taken in performing the fixing processing on the sheet β1 from when the triac 56 is turned on until when the temperature of the fixing nip portion N reaches the target temperature TE2 is used as a parameter. Moreover, a time Twarmα taken in performing the fixing processing on the sheet α2 from when the triac 56 is turned on until when the temperature of the fixing nip portion N reaches the target temperature TE2 is used as a parameter.

$$Tth9=(Tlen\alpha+Toff+Tsw)\times 2+Twarm\beta+Twarm\alpha+Tlen\beta \quad (1)$$

As described above, as with the description with reference to FIG. 6A to FIG. 6F, in a case where the heat generation member switching device 57 is switched, the time for the switching and the time taken by the decreased temperature of the edge portion of the fixing nip portion N to reach the target temperature TE2 are needed.

(Without Switching)

Figures 8A, 8B, 8C, 8D, 8E, 8F:
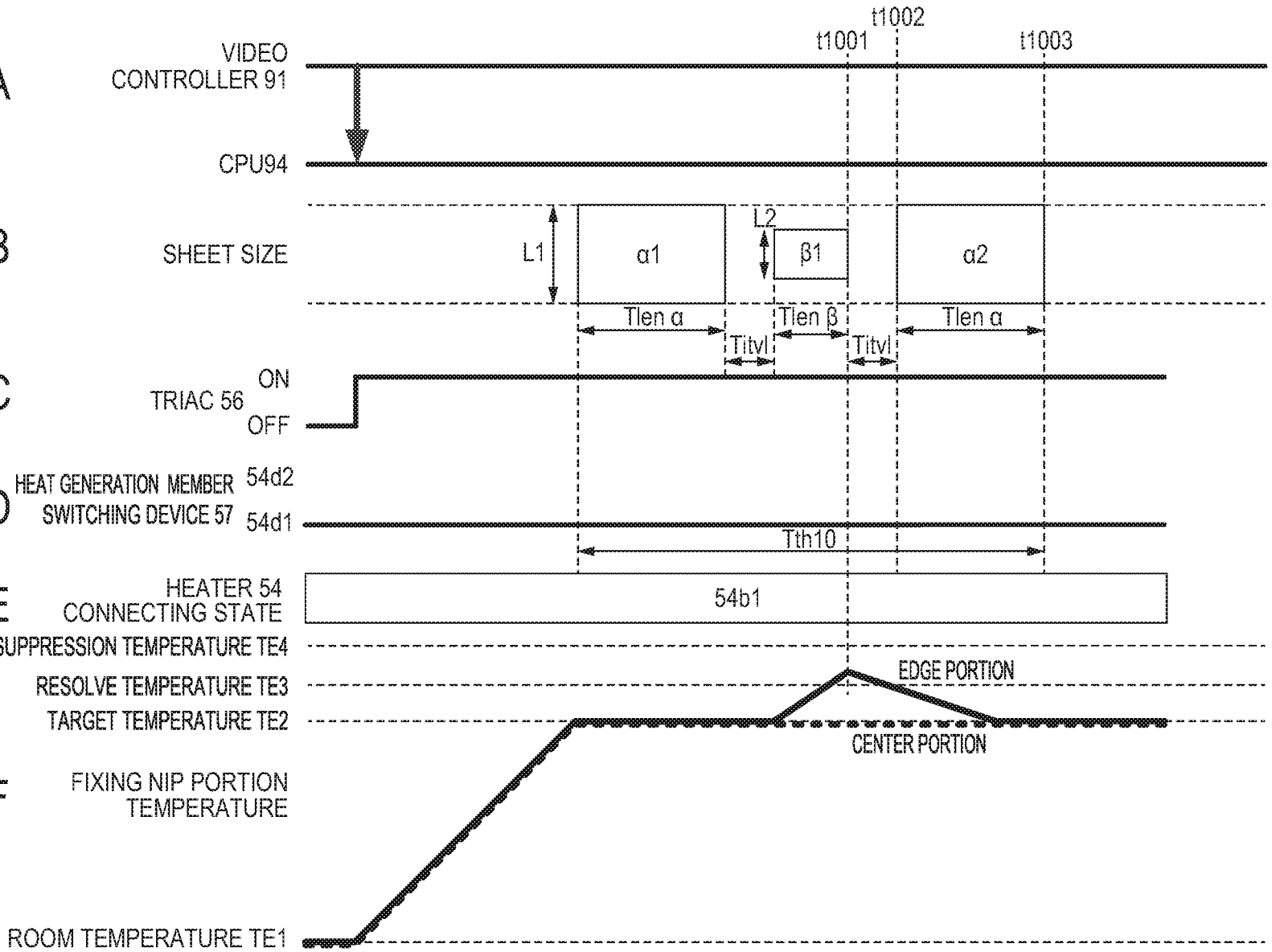
FIGS. 8A, 8B, 8C, 8D, 8E and 8F are timing diagrams illustrating operation by the image forming apparatus in Embodiment 1.

Next, FIG. 8A to FIG. 8F will be described. In FIG. 8A to FIG. 8F, operation from feeding and conveying the sheet β1 and fixing the sheet β1 at the target temperature TE2 is the same as that illustrated in FIG. 5A to FIG. 5F. At a timing t1001 when the fixing of the sheet β1 is ended, the temperature of the edge portion of the fixing nip portion N does not reach the suppression temperature TE4, as in FIG. 5F (FIG. 8F). Therefore, the CPU 94 performs sheet feeding operation such that a sheet interval between the sheet β1 and the sheet α2 becomes the minimum sheet interval Titv1. The sheet α2 is thereby fed and conveyed and then enters the fixing nip portion N in a state where the fixing nip portion N is at the target temperature TE2 (t1002) (FIG. 8F). The sheet α2 is then fixed at target temperature TE2 to its trailing edge and passes the fixing nip portion N (t1003).

In FIG. 8A to FIG. 8F, a time Tth10 from when the leading edge of the sheet α1 enters the fixing nip portion N until when the trailing edge of the sheet α2 passes through the fixing nip portion N is calculated by the following Formula (2).

To calculate the time Tth10, the conveyance time Tlenα of the sheets α1 and α2, the conveyance time Tlenβ of the sheet β1, and the minimum sheet interval Titv1 are used as parameters.

$$Tth10=(Tlen\alpha+Titv1)\times 2+Tlen\beta \quad (2)$$

As described above, in a case where a number of L2-width sheets is one, the temperature of the edge portions of the fixing nip portion N does not reach the suppression temperature TE4, and thus the print can be performed on all of the sheets α1, β1 and α2 with the minimum sheet interval. In addition, the time Tsw for switching the heat generation member switching device 57 and the wait time Twarmα and Twarmβ taken by the temperature of the edge portions of the fixing nip portion N to reach the target temperature TE2, which are described above with reference to FIG. 7A to FIG. 7F, are not needed. As a result, the time Tth10 is shorter than the time Tth9 (Tth10<Tth9).

From the above, in a case where the number of L2-width sheets β is small, not switching the heat generation member switching device 57 can rather provide an optimum throughput.

As described above with reference to FIG. 5A to FIG. 5F, FIG. 6A to FIG. 6F, FIG. 7A to FIG. 7F, and FIG. 8A to FIG. 8F, the following can be said about the image forming apparatus in which the heater 54 can be switched. That is, in a case where print on L2-width sheets β is performed between two times of print on L1-width sheets α, one of a case where switching the heat generation member 54 reduces the throughput and a case where not switching the heat generation member 54 reduces the throughput occurs according to a number of the L2-width sheets β. From this regard, the image forming apparatus in Embodiment 1 switches the heater 54 using the heat generation member switching device 57 in a case where a number of L2-width sheets β to be printed between two times of print performed on L1-width sheets α is not less than a predetermined sheet number, as illustrated in FIG. 6A to FIG. 6F. From this regard, the image forming apparatus in Embodiment 1 switches the heater 54 using the heat generation member switching device 57 in a case where a number of L2-width sheets β to be printed between two times of print performed on L1-width sheets α is less than a predetermined number of sheets, as illustrated in FIG. 8A to FIG. 8F. With this configuration, the productivity is maximized. The predetermined number of sheets is determined according to, for example, the widths or the sheet sizes of the sheets P, the degree of the edge portion temperature rise, the time taken by the temperature of the fixing nip portion N to reach the target temperature TE2 from the room temperature TE1.

[Heat Generation Member Switching Determination Process in Embodiment 1]

Figure 9:
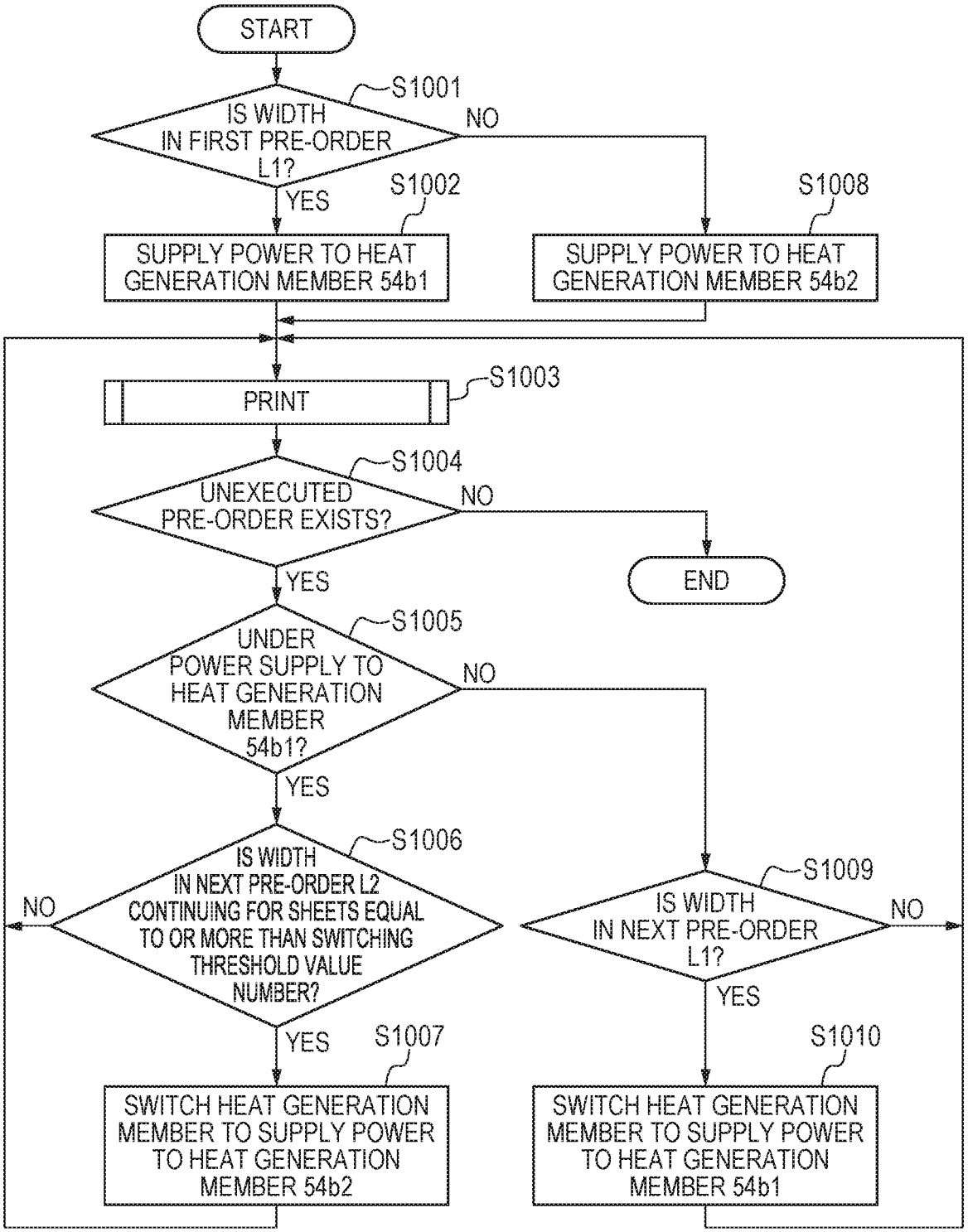
FIG. 9 is a flowchart illustrating heater switching determination by the image forming apparatus in Embodiment 1.

FIG. 9 is a flowchart illustrating a heat generation member switching determination process by the image forming apparatus in Embodiment 1. Control after the CPU 94 receives printing instructions from the video controller 91 will be described. Upon receiving the printing instructions from the video controller 91, the CPU 94 executes a process including step (hereinafter, abbreviated to s) 1001 and steps subsequent to step s1001.

In s1001, the CPU 94 determines whether a pre-order for a first sheet P is a pre-order for an L1-width sheet α. In s1001, in a case where the CPU 94 determines that the pre-order for the first sheet P is a pre-order for an L1-width sheet α, the CPU 94 proceeds the process to s1002, or in a case where the CPU 94 determines that the pre-order is a pre-order not for an L1-width sheet but for an L2-width sheet β, the CPU 94 proceeds the process to s1008. In s1002, the CPU 94 turns on the triac 56 to supply electric power to the heat generation member 54*b*1. In s1008, the CPU 94 turns on the triac 56 to supply electric power to the heat generation member 54*b*2. In Embodiment 1, it is assumed that, for example, the heat generation member switching device 57 is connected to the heat generation member 54*b*1 when electric power is not supplied to the heater 54. In s1008, it is assumed that the CPU 94 switches from the heat generation member 54*b*1 to the heat generation member 54*b*2 using the heat generation member switching device 57 before turning on the triac 56. In s1003, the CPU 94 performs the print. Operation of the print is as previously described.

In s1004, the CPU 94 determines whether an unexecuted pre-order exists, and in a case where the CPU 94 determines that no unexecuted pre-order exists, the CPU 94 ends the process. In a case where the CPU 94 determines in s1004 that an unexecuted pre-order exists, the CPU 94 proceeds the process to s1005. In s1005, the CPU 94 determines whether the heat generation member 54*b*1 is currently connected, and electric power is supplied to the heat generation member 54*b*1. In a case where the CPU 94 determines in s1005 that electric power is supplied to the heat generation member 54*b*1, the CPU 94 proceeds the process to s1006, or in a case where the CPU 94 determines that electric power is supplied not to the heat generation member 54*b*1 but to heat generation member 54*b*2, the CPU 94 proceeds the process to s1009. In s1006, the CPU 94 determines whether the next pre-orders are pre-orders for L2-width sheets β and continue for sheets equal to or more than the predetermined number of sheets previously described (hereinafter, referred to as a switching threshold value number of sheets).

In a case where the CPU 94 determines in s1006 that the next pre-orders are pre-orders for L2-width sheets β and continue for sheets equal to or more than the switching threshold value number of sheets, the CPU 94 proceeds the process to s1007. In this case, the process illustrated in FIG. 6A to FIG. 6F previously described should be performed. In s1007, the CPU 94 switches the heater 54 from the heat generation member 54*b*1 to the heat generation member 54*b*2 using the heat generation member switching device 57, supplies electric power to the heat generation member 54*b*2, and returns the process to s1003. Operation of the switching is as previously described. Thereafter, the CPU 94 performs the print.

In s1006, in a case where the CPU 94 determines that the next pre-order is a pre-order for an L1-width sheet α or that the next pre-order is for L2-width sheets β but a number of the pre-ordered sheets β is less than the switching threshold value number of sheets (less than the predetermined number of sheets), the CPU 94 proceeds the process to s1003. In this case, the CPU 94 continues the print without switching the heater 54.

In s1009, the CPU 94 determines whether the next pre-order is a pre-order for an L1-width sheet α. In s1009, in a case where the CPU 94 determines that the next pre-order is a pre-order for an L1-width sheet α, the CPU 94 proceeds the process to s1010, or in a case where the CPU 94 determines that the next pre-order is a pre-order not for an L1-width sheet but for an L2-width sheet β, the switching of the heater 54 is unnecessary, and thus the CPU 94 proceeds the process to s1003. In s1010, the CPU 94 switches the heater 54 from the heat generation member 54*b*2 to the heat generation member 54*b*1 using the heat generation member switching device 57, supplies electric power to the heat generation member 54*b*1, returns the process to s1003, and continues the print. The CPU 94 then continues the print until determining that no unexecuted pre-order exists. From the above, in a case where a plurality of sheets P including sheets P having different widths mixed are to be printed, the CPU 94 controls the switching of the heater 54 by the heat generation member switching device 57 based on a number of sheets β having substantially the same width to be printed continuously.

As described above, the image forming apparatus in Embodiment 1 determines whether to switch the heater 54 using the heat generation member switching device 57 according to a size and a number of sheets P to be printed. With this configuration, the productivity is maximized. In addition, this configuration eliminates the wait time for switching the heater 54 and the wait time during which the temperature of the fixing nip portion N reaches the temperature that enables the fixing, which are described about the conventional image forming apparatus. As a result, the productivity can be enhanced as compared with the conventional image forming apparatus.

As described above, according to Embodiment 1, the productivity can be enhanced while the damage to the fixing device and the occurrence of the poor fixing are prevented.

Embodiment 2

The image forming apparatus in Embodiment 1 determines the switching of the heater 54 according to the number of sheets β to be printed having the width smaller than the width of the L1-width sheet α in a case where the sheets β having the width smaller than the width of the L1-width sheet α between times of print performed on L1-width sheets α. This aims at maximizing the productivity while maintaining a quality of printed matters. In Embodiment 2, the following determination is made in a case where a job for a first sheet based on printing information is print on an L2-width sheet β, and print on an L1-width sheet α exists after the job. That is, whether to switch the heat generation member switching device 57 is determined according to a number of L2-width sheets β followed by an L1-width sheet α to be printed. This aims at maximizing the productivity. As described above, a major difference from the image forming apparatus in Embodiment 1 is to determine whether to switch the heat generation member switching device 57 performed when the CPU 94 receives printing instructions from the video controller 91, which will be described below with reference to a flowchart. An image forming apparatus in Embodiment 2 is an image forming apparatus having the same configuration as illustrated in FIG. 1 to FIG. 4B in Embodiment 1.

[Heat Generation Member Switching Determination Process in Embodiment 2]

Figure 10:
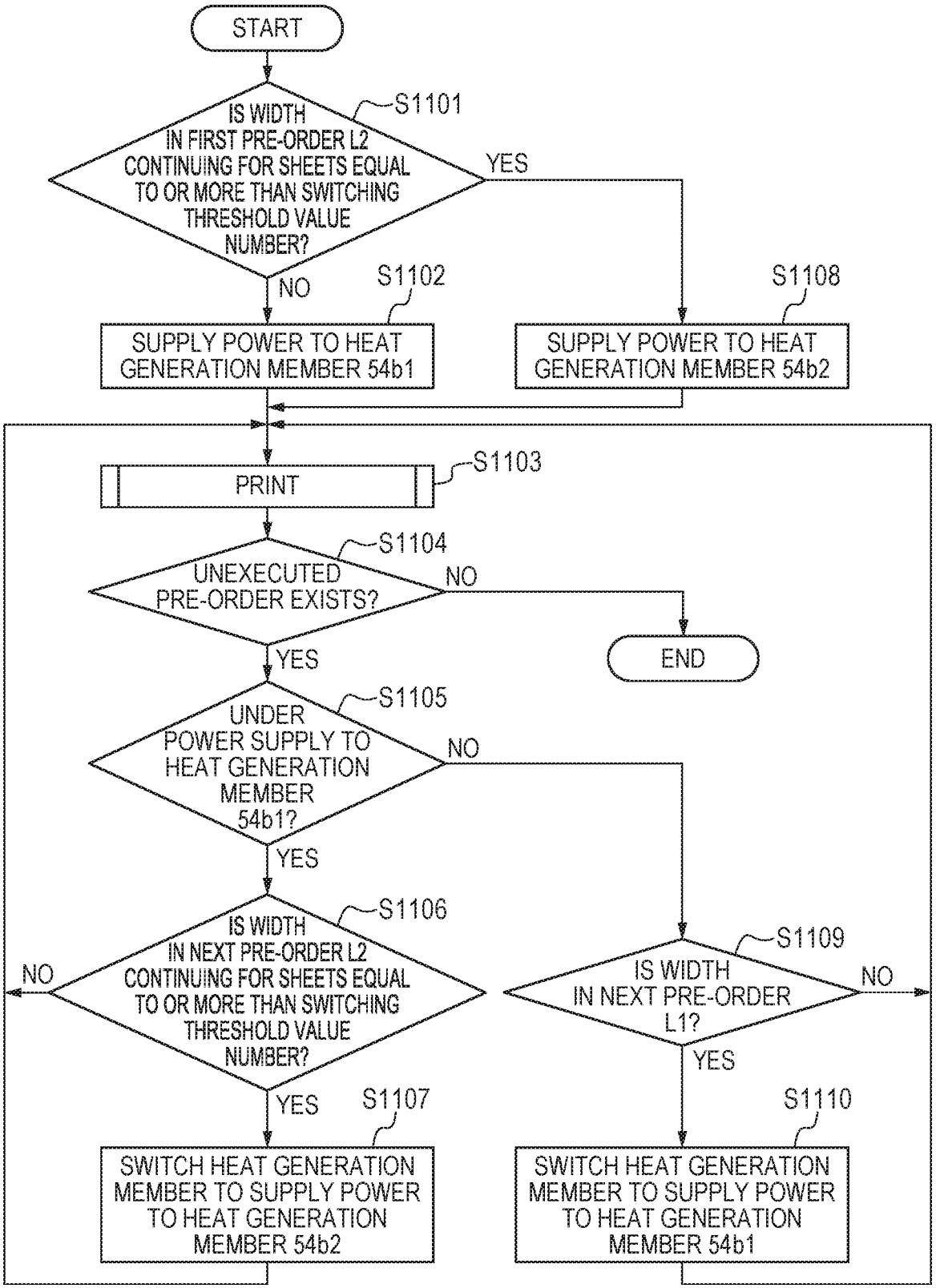
FIG. 10 is a flowchart illustrating heater switching determination by an image forming apparatus in Embodiment 2.

FIG. 10 is a flowchart illustrating a heat generation member switching determination process in Embodiment 2. Control after the CPU 94 receives printing instructions from the video controller 91 will be described. In s1101, the CPU 94 determines whether a pre-order for a first sheet is a pre-order for an L2-width sheet β, and the subsequent pre-orders for L2-width sheets β continue for sheets equal to or more than the switching threshold value number of sheets. In a case where the CPU 94 determines in s1101 that the pre-order for a first sheet is a pre-order for an L2-width sheet β, and the subsequent pre-orders for L2-width sheets β continue for sheets equal to or more than the switching threshold value number of sheets, the CPU 94 proceeds the process to s1108. In s1108, the CPU 94 switches to the heat generation member 54*b*2 using the heat generation member switching device 57 and turns on the triac 56 to supply electric power to the heat generation member 54*b*2. In a case where the CPU 94 determines in s1101 that the pre-order for a first sheet is a pre-order for an L1-width sheet α, or that the pre-order for a first sheet is a pre-order for an L2-width sheet β but the subsequent pre-orders are for L2-width sheets β less than the switching threshold value number of sheets, the CPU 94 proceeds the process to s1102. The CPU 94 turns on the triac 56 to supply electric power to the heat generation member 54*b*1. The CPU 94 thereafter performs the same control as the control by the image forming apparatus in Embodiment 1 described with reference to FIG. 9. That is, processes of s1103 to s1107, s1109 and s1110 are the same as processes of s1003 to s1007, s1009 and s1010 in FIG. 9.

As described above, the image forming apparatus in Embodiment 2 determines whether to switch the heat generation member switching device 57 according to a size of a sheet P to be printed as a first sheet in a job and a size and a number of subsequent sheets P to be printed in the job. With this configuration, the productivity is maximized. In addition, this configuration eliminates the wait time for switching the heat generation members and the wait time during which the temperature of the fixing nip portion N reaches the temperature that enables the fixing, which are described about the conventional image forming apparatus. As a result, the productivity can be enhanced as compared with the conventional image forming apparatus.

As described above, according to Embodiment 2, the productivity can be enhanced while the damage to the fixing device and the occurrence of the poor fixing are prevented.

Embodiment 3

The image forming apparatus in Embodiment 1 determines the switching of the heat generation member according to the number of sheets β to be printed having the width smaller than the width of the L1-width sheet α in a case where the sheets β having the width smaller than the width of the L1-width sheet α between times of print performed on L1-width sheets α. This aims at maximizing the productivity while maintaining a quality of printed matters.

In Embodiment 3, the following control is performed when the heater 54 is switched to the heat generation member 54*b*1 for an L1-width sheet α that is to be printed after an L2-width sheet β while the L2-width sheet β is being fixed using the heat generation member 54*b*2. That is, the switching is performed in advance at a timing previous to a timing for this L1-width sheet α not at the timing for the L1-width sheet α, at some temperature of the edge portions of the fixing nip portion N. This causes the edge portion temperature rise, thereby reducing the wait time during which the temperature of the edge portions of the fixing nip portion N reaches the target temperature TE2, which further enhances the productivity.

These regards will be described below. In describing these regards, as a case of the switching of the heater 54, behavior in a case where sheets P of different widths are mixed in one job, such as a case where, seven sheets are printed in an order of an L1-width sheet α1, L2-width sheets β1 to β5, and an L1-width sheet α2, as in FIG. 6A to FIG. 6F, will be described. Content overlapping the content of Embodiment 1 will not be described. An image forming apparatus in Embodiment 3 is an image forming apparatus having the same configuration as illustrated FIG. 1 to FIG. 4B in Embodiment 1. In Embodiment 3, it is assumed that the fixing temperature sensor 59 being a detection unit includes a sensor for detecting the temperature of the center portion of the heater 54 and a sensor for detecting the temperature of the edge portions of the heater 54. The sensor for detecting the temperature of the edge portions of the heater 54 may be provided in one of the edge portions, or two sensors for detecting the temperature of the edge portions of the heater 54 may be provided on both the edge portions.

[Image Forming Apparatus in Embodiment 3]

The image forming apparatus in Embodiment 1 switches the heat generation member using the heat generation member switching device 57 during the sheet interval between the sheet β5 and the sheet α2 having different sheet sizes. In contrast, the image forming apparatus in Embodiment 3 performs the switching using the heat generation member switching device 57 in a sheet interval previous to the sheet β5 in a case where a difference in temperature between the edge portions and the center portion of the fixing nip portion N (hereinafter, referred to as temperature difference). This causes a temperature rise of the edge portions, of which the temperature has decreased with respect to the target temperature TE2, while an L2-width sheet β is passing through the fixing apparatus 50. The wait time during which the temperature of the edge portions of the fixing nip portion N reaches the target temperature TE2 is thus reduced. At that time, in which of sheet intervals for sheets β previous to the sheet β5 the switching is performed is determined according to the temperature difference between the edge portions and the center portion of the fixing nip portion N.

FIG. 11A to FIG. 11F are diagrams illustrating a process performed in Embodiment 3, which are similar to FIG. 6A to FIG. 6F. Let the temperature of the center portion of the fixing nip portion N be denoted by Tc, the temperature of the edge portions be denoted by Te, and the temperature difference between the temperature Tc of the center portion and the temperature Te of the edge portion be denoted by ΔT. In FIG. 11A to FIG. 11F, at a timing t1200 when the sheet β3 passes through the fixing apparatus 50, the temperature difference ΔT1 between the edge portions and the center portion of the fixing nip portion N does not reach a temperature difference at which the heater 54 is switched. Specifically, the difference ΔT1 at the timing t1200 between the temperature Tc1 of the center portion and the temperature Te1 of the edge portions of the fixing nip portion N is less than a temperature difference TEd being a threshold value for determining whether to switch the heater 54 (ΔT1<TEd). A case where, at a timing t1201 thereafter when the sheet β4 passes through the fixing apparatus 50, a temperature difference ΔT2 between the edge portions and the center portion of the fixing nip portion N reaches the temperature at which the heater 54 is switched will be described. Specifically, the difference ΔT2 at the timing t1201 between the temperature Tc2 of the center portion and the temperature Te2 of the edge portions of the fixing nip portion N is equal to or more than a temperature difference TEd being the threshold value for determining whether to switch the heater 54 (ΔT2≥TEd). Operation from feeding and conveying the sheet β4 to fixing the sheet β4 at the target temperature TE2 is the same as that of the case illustrated with reference to FIG. 6A to FIG. 6F and will not be described.

Figures 11A, 11B, 11C, 11D, 11E, 11F:
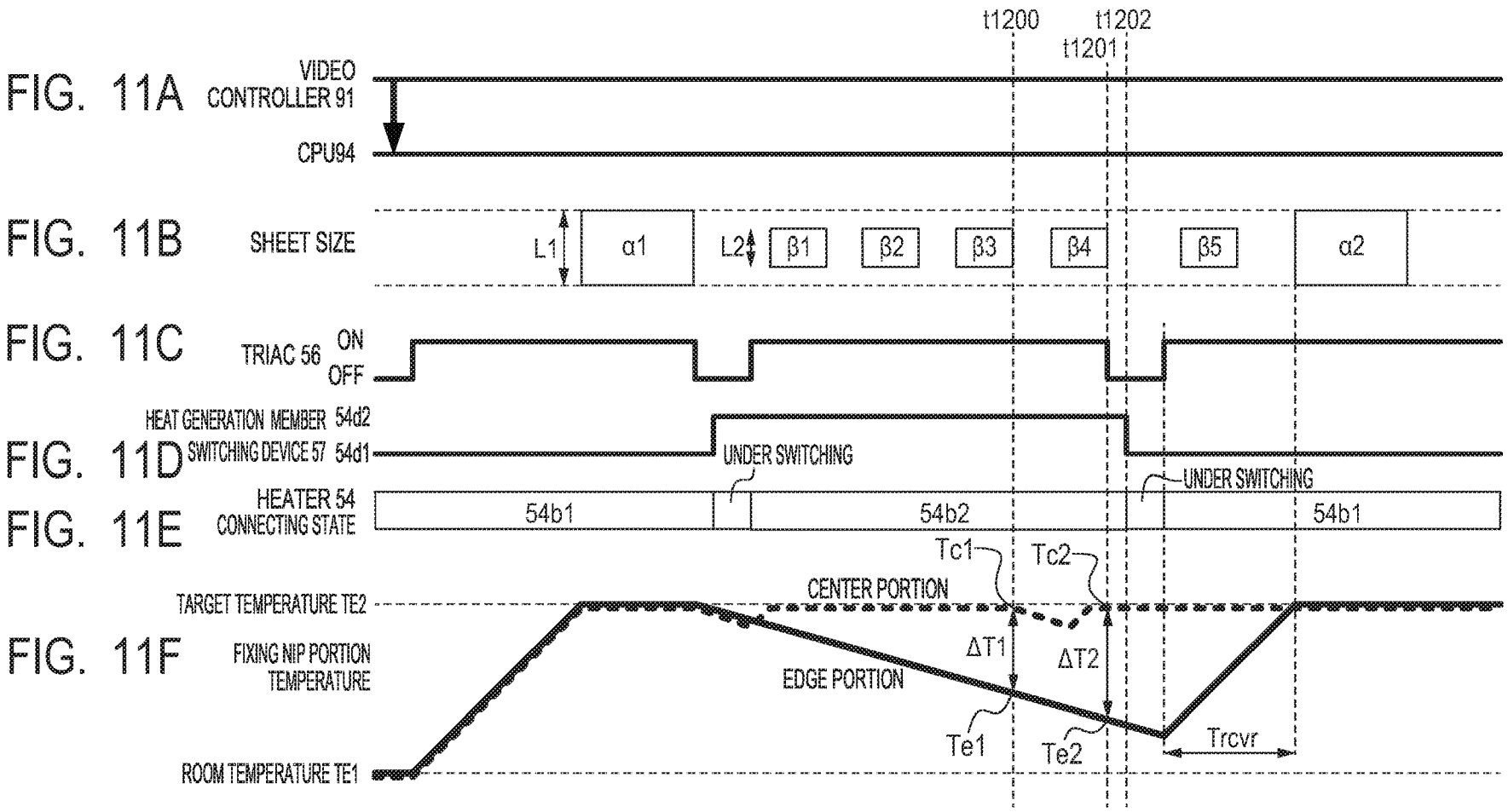
FIGS. 11A, 11B, 11C, 11D, 11E and 11F are timing diagrams illustrating operation by an image forming apparatus in Embodiment 3.

At the timing t1201 when the sheet β4 passes through the fixing nip portion N, the temperature difference ΔT2 between the edge portions and the center portion of the fixing nip portion N reaches the temperature difference TEd for the switching. At that timing t1201, the CPU 94 turns off the triac 56 (FIG. 11C) and switches the heater 54 from the heat generation member 54*b*2 to the heat generation member 54*b*1 using the heat generation member switching device 57 (FIG. 11E). The switching at that timing causes a temperature rise of the edge portions of the fixing nip portion N, of which the temperature has decreased with respect to the target temperature TE2 during print on the sheets β1 to β4, while the sheet β5 is passing through the fixing apparatus 50. This thus enables a wait time Trcvr during which the temperature Te of the edge portions of the fixing nip portion N reaches the target temperature TE2 to be started at an earlier timing, which enables a time between the sheet β5 and the sheet α2 to be shortened. The temperature difference TEd as the threshold value and a temperature TE6 to rise a temperature of the fixing nip portion N to the target temperature TE2 are determined as the following temperatures. That is, the temperatures are determined as temperatures with which the temperature Te of the edge portions of the fixing nip portion N does not exceed the target temperature TE2 by the temperature rise that occurs while the sheet β5 is passing through the fixing apparatus 50.

[Heat Generation Member Switching Determination Process in Embodiment 3]

Figure 12:
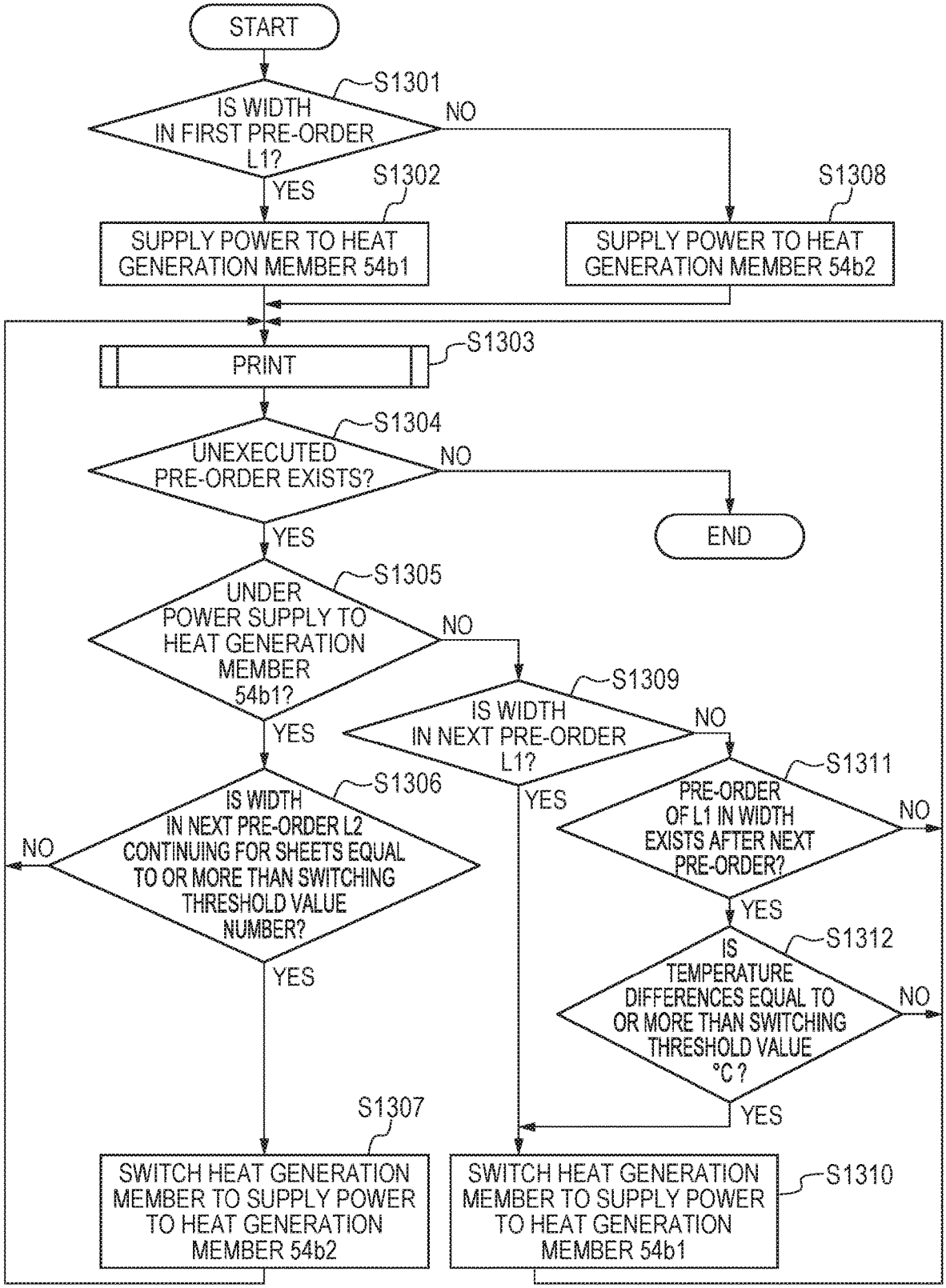
FIG. 12 is a flowchart illustrating heater switching determination by the image forming apparatus in Embodiment 3.

FIG. 12 is a flowchart illustrating a heat generation member switching determination process in Embodiment 3. Control after the CPU 94 receives printing instructions from the video controller 91 will be described. Processes of s1301 to s1310 in the flowchart of the FIG. 12 are the same as the processes of s1001 to s1010 in FIG. 9. Therefore, only matters relating to s1311 and s1312, which are different from FIG. 9, will be described.

In s1311, the CPU 94 determines whether a pre-order for an L1-width sheet α exists after the next pre-order. In a case where the CPU 94 determines in s1311 that the pre-order for an L1-width sheet α does not exist after the next pre-order, the CPU 94 returns the process to s1303 to continue the print as it is. In a case where the CPU 94 determines in s1311 that the pre-order for an L1-width sheet α exists after the next pre-order, the CPU 94 proceeds the process to s1312. In s1312, the CPU 94 determines whether the temperature difference ΔT between the temperature Te of the edge portions and the temperature Tc of the center portion of the fixing nip portion N is equal to or more than the switching threshold value ° C. (equal to or more than a predetermined temperature difference). Here, the switching threshold value ° C. is the temperature difference TEd previously described.

In a case where the CPU 94 determines in s1312 that the temperature difference ΔT is equal to or more than the switching threshold value ° C. (ΔT≥TEd), the CPU 94 proceeds the process to s1310. The CPU 94 switches the heater 54 from the heat generation member 54*b*2 to the heat generation member 54*b*1 using the heat generation member switching device 57, supplies electric power to the heat generation member 54*b*1 (s1310), and continues the print (s1303). In a case where the CPU 94 determines in s1312 that the temperature difference ΔT is less than the switching threshold value ° C. (less than the predetermined temperature difference) (ΔT<TEd), the CPU 94 returns the process to s1303 to continue the print as it is.

As described above, the image forming apparatus in Embodiment 3 performs the following control when the heat generation member 54*b*2 is switched to the heat generation member 54*b*1 for an L1-width sheet α that is to be printed after an L2-width sheet β while the fixing processing is being performed on the L2-width sheet β using the heat generation member 54*b*2. That is, the CPU 94 does not switch the heater 54 at a timing for this L1-width sheet α but switches the heater 54 at a timing previous to the timing for the L1-width sheet α, at some temperature Te of the edge portions of the fixing nip portion N. This causes the wait time Trcvr during which the temperature Te of the edge portion of the fixing nip portion N reaches the target temperature TE2 to be started earlier to further reduce the time corresponding to a sheet interval between a sheet β and a sheet α, thereby further enhancing the productivity. Note that the control for the first sheet P in Embodiment 2 may be applied to the control in Embodiment 3.

As described above, according to Embodiment 3, the productivity can be enhanced while the damage to the fixing device and the occurrence of the poor fixing are prevented.

In the embodiments previously described, the heater 54 has the configuration with the two heat generation members including the heat generation member 54*b*1 and the heat generation member 54*b*2, but note that the heater 54 may have a configuration that includes three or more heat generation members and switches between the three or more heat generation members.

Embodiment 4

The image forming apparatus in Embodiments 1, 2 and 3 determines whether to switch between the two kinds of the heat generation members having different length in the longitudinal direction according to sizes and numbers of sheets P to be printed. In addition, this configuration eliminates the wait time for switching the heater 54 and the wait time during which the temperature of the fixing nip portion N reaches the temperature that enables the fixing, which are described about the conventional image forming apparatus. As a result, the productivity can be enhanced as compared with the conventional image forming apparatus.

The image forming apparatus in Embodiment 4 is the same as that in Embodiments 1, 2 and 3 in that whether to switch between the heat generation members is determined according to a size and a number of sheets P to be printed. However, the image forming apparatus in Embodiment 4 includes, for example, three kinds of heat generation members having different length in the longitudinal direction, by which the image forming apparatus supports more sizes (more in detail, widths) of sheets, enhancing the productivity in more print cases. In a heater 54, a plurality of heat generation members will be collectively referred to as heat generation member 54*m*, and a plurality of contacts will be collectively referred to as contacts 54*n*.

(Heater and Power Control Unit)

Figure 13:
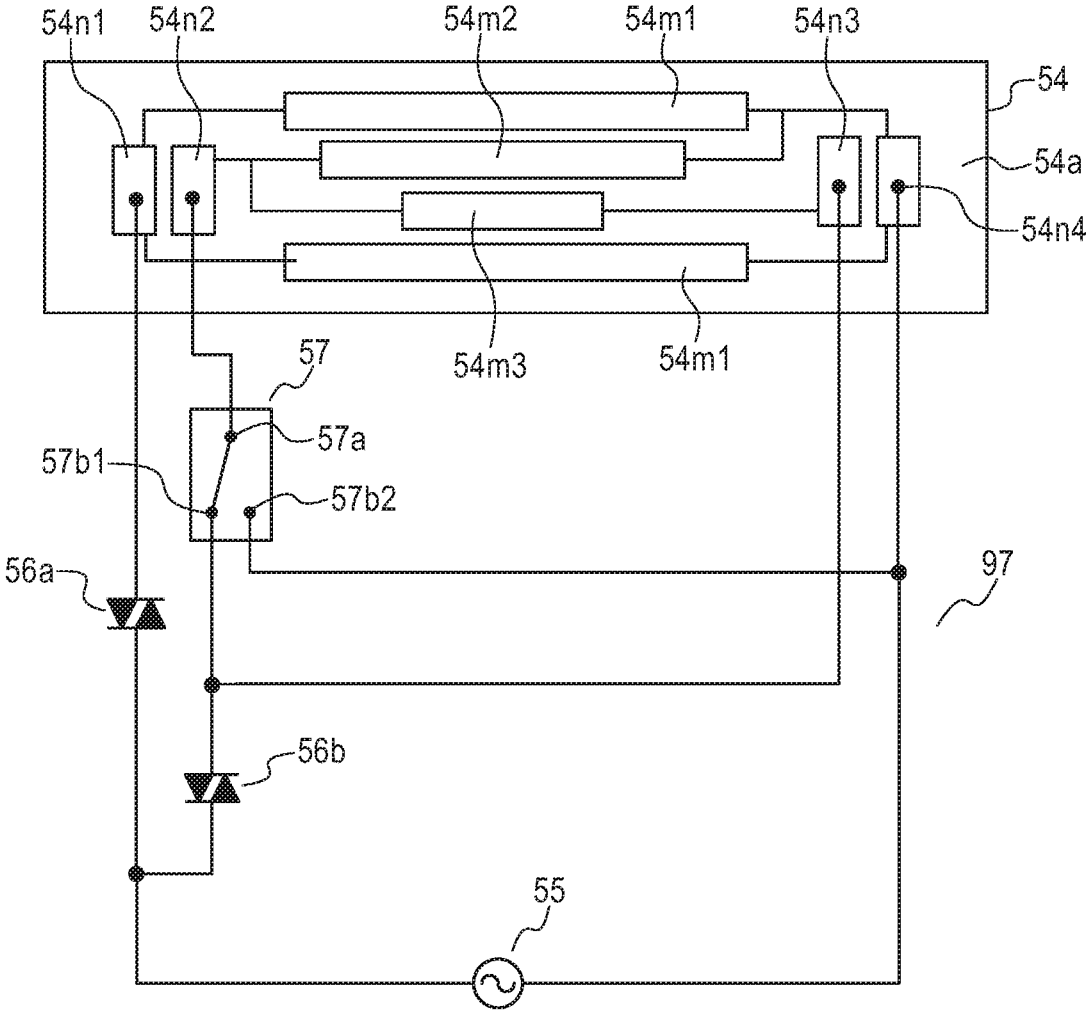
FIG. 13 is a schematic diagram of a heater in Embodiment 4 and a schematic diagram of a power control circuit of a fixing apparatus in Embodiment 4.

A heater 54 and a power control unit 97 used in a fixing apparatus 50 in Embodiment 4 are illustrated in FIG. 13. The heater 54 in Embodiment 4 includes a larger number of heat generation members 54*m* and contacts 54*n* than heat generation members and contacts of the heater 54 illustrated in FIG. 3, FIG. 4A and FIG. 4B and is therefore different from the heater 54 in Embodiments 1, 2 and 3. In Embodiment 4, the three kinds of the heat generation members 54*m*, specifically heat generation members 54*m*1, a heat generation member 54*m*2, and a heat generation member 54*m*3 are included. In addition, in Embodiment 4, four contacts 54*n*, specifically, a contact 54*n*1, a contact 54*n*2, a contact 54*n*3, and a contact 54*n*4 are included. Similarly, the power control unit 97 in Embodiment 4 includes two triacs 56*a* and 56*b* in contrast to the circuit illustrated in FIG. 4B and is different in electrical connection from the power control unit 97 in Embodiments 1, 2 and 3. These regards will be described below more in detail. Note that configurations of components other than the heater 54 and the power control unit 97 are the same as configurations of components of Embodiments 1, 2 and 3 and will not be described.

The heater 54 is mainly constituted by the heat generation members 54*m*1 to 54*m*3 mounted on a substrate 54*a* formed of ceramic or the like (on the substrate), the contacts 54*n*1 to 54*n*4, and a protection glass layer 54*e* made of an insulation glass or the like. The heat generation members 54*m*1 to 54*m*3 are resistive bodies that generate heat with supply of electric power from an AC power supply 55 such as a commercial AC power supply. The contact 54*n*1 and the contact 54*n*2 are provided in one edge portion of the substrate 54*a* in the longitudinal direction, and the contact 54*n*3 and the contact 54*n*4 are provided in the other edge portion of the substrate 54*a* in the longitudinal direction. In this manner, a number of contacts 54*n* (electrodes) provided on each of edge portions of the substrate 54*a* in the longitudinal direction is set to be the same number, for example, two. The protection glass layer 54*e* is provided to insulate a user from the heat generation members 54*m*1 to 54*m*3 at substantially the same electric potential as that of the AC power supply 55.

The heat generation members 54*m*1 being first heat generation members are heat generation members that are used to fix toner mainly on a sheet P having a largest width of sheets P conveyable by the fixing apparatus 50. Therefore, a length (dimension) of the heat generation members 54*m*1 in the longitudinal direction is set to be longer than a width of letter size, 215.9 mm (hereinafter, referred to also as an L1 width) by about several millimeters. As illustrated in FIG. 13, two heat generation members 54*m*1 are provided such that the heat generation members 54*m*1 sandwich the heat generation members 54*m*2 and 54*m*3 from an upstream side and a downstream side in the conveyance direction of a sheet P (in a vertical direction of FIG. 13). The heat generation members 54*m*1 are connected to the contact 54*n*1 being a first contact and the contact 54*n*4 being a fourth contact.

From the above, the heat generation members 54*m*1, 54*m*2 and 54*m*3 are provided on the substrate 54*a* in Embodiment 4. The heat generation members 54*m*1 include two heat generation members including one heat generation member 54*m*1 provided at one edge portion of the substrate 54*a* in a width direction and the other heat generation member 54*m*1 provided at the other edge portion. In the width direction of the substrate 54*a*, the one heat generation member 54*m*1, the heat generation member 54*m*2, the heat generation member 54*m*3, and the other heat generation member 54*m*1 are provided in this order.

The heat generation member 54*m*2 being a second heat generation member and a third heat generation member is a heat generation member that supports a width of B5 size, and a length of the heat generation member 54*m*2 in the longitudinal direction is set to be longer than the width of B5 size, 182 mm (hereinafter, referred to also as L2 width) by about several millimeters. The heat generation member 54*m*2 is connected to the contact 54*n*2 being a second contact and the contact 54*n*4. The heat generation member 54*m*3 being a second heat generation member and a fourth heat generation member is a heat generation member that supports a width of A5 size, and a length of the heat generation member 54*m*3 in the longitudinal direction is set to be longer than the width of A5 size, 148 mm (hereinafter, referred to also as L3 width) by about several millimeters. The heat generation member 54*m*3 is connected to the contact 54*n*2 and the contact 54*n*3 being a third contact.

As previously described, the contact 54*n*1 is a contact to which one edge portions of the one heat generation member 54*m*1 and the another heat generation member 54*m*1 are electrically connected. The contact 54*n*4 is a contact to which the other edge portions of the one heat generation member 54*m*1 and the other heat generation member 54*m*1, and another edge portion of the heat generation member 54*m*2 are electrically connected. The contact 54*n*2 is a contact to which one edge portion of the heat generation member 54*m*2 and the heat generation member 54*m*3 are electrically connected. The contact 54*n*3 is a contact to which the other edge portion of the heat generation member 54*m*3 is electrically connected.

The heater 54 includes three systems of the heat generation members 54*m*1 to 54*m*3 having different lengths, in a width direction of a sheet P. This aims at suppressing the non-sheet-feeding portion temperature rise and providing a high productivity even in a case where sheets P having widths smaller than widths of letter size and A4 size are printed. Therefore, performance of the heater 54 can be delivered also from this viewpoint by switching between the heat generation members 54*m*1 and the heat generation members 54*m*2 and 54*m*3.

The power control unit 97 includes the heater 54, the AC power supply 55, the triacs 56*a* and 56*b*, and a heat generation member switching device 57. The heat generation member switching device 57 includes a contact 57*a* connected to the contact 54*n*2, a contact 57*b*1 connected to the triac 56*b* and the contact 54*n*3, and a contact 57*b*2 connected to the AC power supply 55 and the contact 54*n*4. In a state where the contact 57*a* is connected to the contact 57*b*1, the heat generation member switching device 57 is in a state where electric power can be supplied to the heat generation member 54*m*2. In a state where the contact 57*a* is connected to the contact 57*b*2, the heat generation member switching device 57 is in a state where electric power can be supplied to the heat generation member 54*m*3.

The triac 56*a* being a first connecting unit includes one end connected to the contact 54*n*1 and the other end connected to the alternating current power supply 55 and the triac 56*b*, and when the triac 56*a* is brought into conduction, electric power is supplied to the heat generation member 54*b*1. The triac 56*b* being a second connecting unit includes one end connected to the alternating current power supply 55 and the triac 56*a* and the other end connected to the contact 57*b*1 of the heat generation member switching device 57 and the contact 54*n*3, and when the triac 56*b* is brought into conduction, electric power is supplied to one of the heat generation members 54*m*2 and 54*m*3 according to a state of the heat generation member switching device 57.

[Heat Generation Member Switching Determination Process in Embodiment 4]

Figure 14:
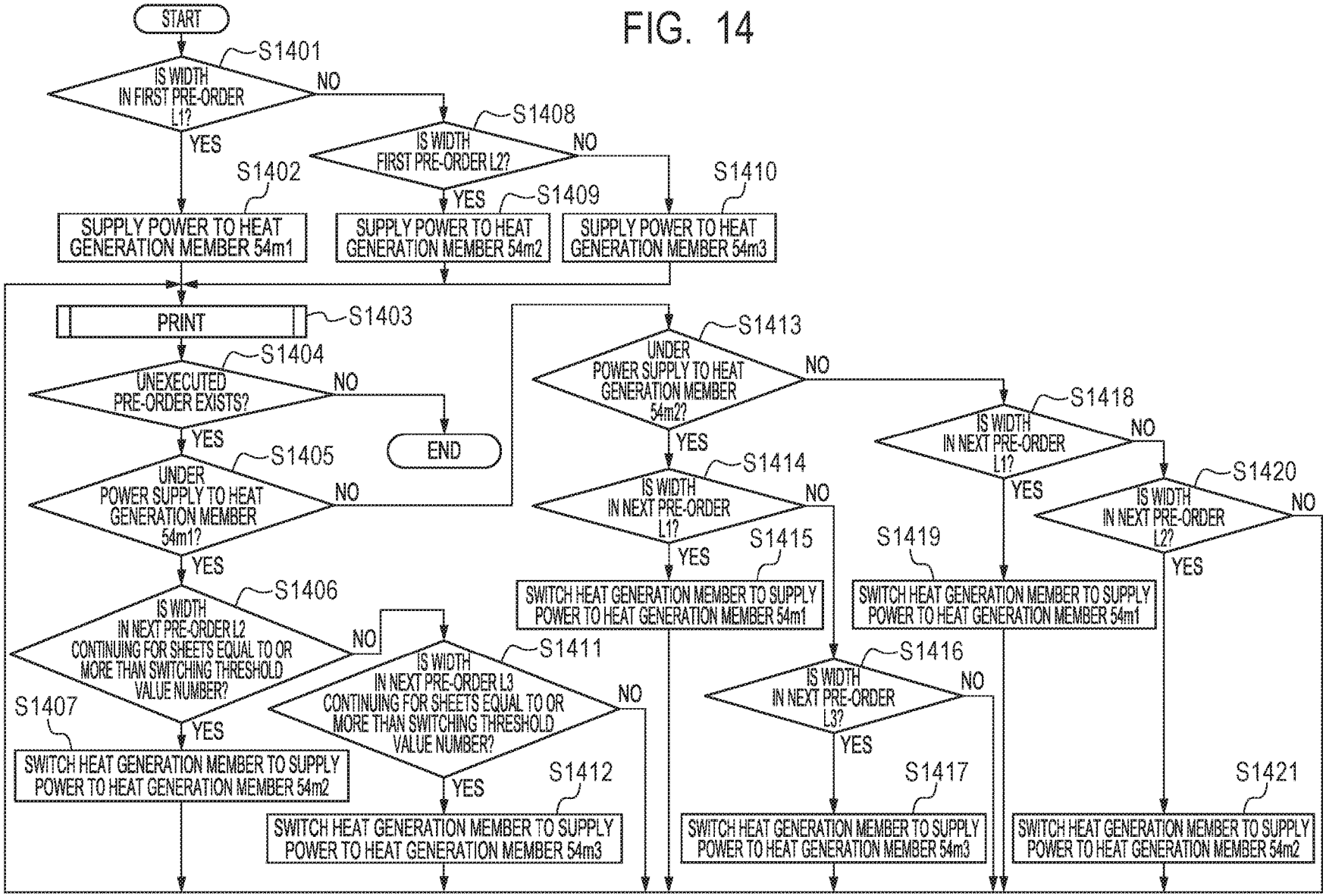
FIG. 14 is a flowchart illustrating heater switching determination by an image forming apparatus in Embodiment 4.

Since the image forming apparatus in Embodiment 4 includes the three kinds of the heat generation members 54*m*, determination and processing by the image forming apparatus in Embodiment 4 as to which of the heat generation members 54*m* are to be used are different from determination and processing by the image forming apparatus in Embodiment 1, 2 and 3, which includes two kinds of heat generation members. Those are explained as below with reference to FIG. 14. FIG. 14 is a flowchart illustrating a heat generation member switching determination process by the image forming apparatus in Embodiment 4. Control after the CPU 94 receives printing instructions from the video controller 91 will be described. Upon receiving printing instructions from the video controller 91, the CPU 94 executes a process including s1401 and steps subsequent to s1401. Processes of s1401 to s1407, s1414 and s1415 are the same as processes of s1001 to s1007, s1009 and s1010 in FIG. 9 and will not be described. In these processes, the heat generation members 54*b* are replaced with the heat generation members 54*m*.

In s1401, in a case where the CPU 94 determines that a pre-order for a first sheet P is not a pre-order for an L1-width sheet α, the CPU 94 proceeds the process to s1408. In s1408, the CPU 94 determines whether the pre-order for a first sheet P is a pre-order for an L2-width sheet β. In a case where the CPU 94 determines in s1408 that the pre-order for a first sheet P is a pre-order for an L2-width sheet β, the CPU 94 proceeds the process to s1409, or in a case where the CPU 94 determines that the pre-order is a pre-order not for an L2-width sheet but for an L3-width sheet γ, the CPU 94 proceeds the process to s1410. In s1409, the CPU 94 turns on the triac 56*b* to supply electric power to the heat generation member 54*m*2. In s1410, the CPU 94 turns on the triac 56*b* to supply electric power to the heat generation member 54*m*3. In Embodiment 4, it is assumed that, for example, the heat generation member switching device 57 is connected to the heat generation member 54*m*2 when electric power is not supplied to the heater 54. In s1410, it is assumed that the CPU 94 switches from the heat generation member 54*m*2 to the heat generation member 54*m*3 using the heat generation member switching device 57 before turning on the triac 56*b*.

In s1406, in a case where the CPU 94 determines that the next pre-order is not a pre-order for an L2-width sheet β or that the next pre-order is for L2-width sheets β but a number of the pre-ordered sheets β is less than the switching threshold value number of sheets, the CPU 94 proceeds the process to s1411. In s1411, the CPU 94 determines whether the next pre-orders are pre-orders for L3-width sheets γ and continue for sheets equal to or more than the switching threshold value number of sheets. In a case where the CPU 94 determines in s1411 that the next pre-orders are pre-orders for L3-width sheets γ and continue for sheets equal to or more than the switching threshold value number of sheets, the CPU 94 proceeds the process to s1412. In s1412, the CPU 94 switches connection of the heater 54 from the heat generation member 54*m*2 to the heat generation member 54*m*3 using the heat generation member switching device 57, turns off the triac 56*a*, turns on the triac 56*b* to supply electric power to the heat generation member 54*m*3, and returns the process to s1403. In s1411, in a case where the CPU 94 determines that the next pre-order is not a pre-order for an L3-width sheet γ or that the next pre-order is for L3-width sheets γ but a number of the pre-ordered sheets γ is less than the switching threshold value number of sheets, the CPU 94 returns the process to s1403.

In s1405, in a case where the CPU 94 determines that electric power is not supplied to the heat generation members 54*m*1, the CPU 94 proceeds the process to s1413. In s1413, the CPU 94 determines whether the heat generation member 54*m*2 is currently connected, and electric power is supplied to the heat generation member 54*m*2. In a case where the CPU 94 determines in s1413 that electric power is supplied to the heat generation member 54*m*2, the CPU 94 proceeds the process to s1414. In s1414, in a case where the CPU 94 determines that the next pre-order is not a pre-order for an L1-width sheet α, the CPU 94 proceeds the process to s1416. In s1416, the CPU 94 determines whether the next pre-order is a pre-order for an L3-width sheet γ. In a case where the CPU 94 determines in s1416 that the next pre-order is the pre-order for an L3-width sheet γ, the CPU 94 proceeds the process to s1417. In s1417, after turning off the triac 56*b*, the CPU 94 switches the connection of the heater 54 from the heat generation member 54*m*2 to the heat generation member 54*m*3 using the heat generation member switching device 57, turns on the triac 56*b* again to supply electric power to the heat generation member 54*m*3, and returns the process to s1403. In a case where the CPU 94 determines in s1416 that the next pre-order is not the pre-order for an L3-width sheet γ, the CPU 94 returns the process to s1403.

In a case where the CPU 94 determines in s1413 that electric power is not supplied to the heat generation member 54*m*2, the CPU 94 proceeds the process to s1418. In s1418, the CPU 94 determines whether the next pre-order is a pre-order for an L1-width sheet α. In a case where the CPU 94 determines in s1418 that the next pre-order is a pre-order for an L1-width sheet α, the CPU 94 proceeds the process to s1419. In s1419, the CPU 94 turns off the triac 56*b*, turns on the triac 56*a* to supply electric power to the heat generation members 54*m*1, and returns the process to s1403. In s1418, in a case where the CPU 94 determines that the next pre-order is not the pre-order for an L1-width sheet α, the CPU 94 proceeds the process to s1420. In s1420, the CPU 94 determines whether the next pre-order is a pre-order for an L2-width sheet β. In a case where the CPU 94 determines in s1420 that the next pre-order is the pre-order for an L2-width sheet β, the CPU 94 proceeds the process to s1421. In s1421, after turning off the triac 56*b*, the CPU 94 switches the connection of the heater 54 from the heat generation member 54*m*3 to the heat generation member 54*m*2 using the heat generation member switching device 57, turns on the triac 56*b* again to supply electric power to the heat generation member 54*m*2, and returns the process to s1403. In a case where the CPU 94 determines in s1420 that the next pre-order is not the pre-order for an L2-width sheet β, the CPU 94 returns the process to s1403.

As seen from the above, the image forming apparatus in Embodiment 4 includes the three kinds of heat generation members having different lengths in the longitudinal direction and performs the heat generation member switching determination process. This enables the image forming apparatus to support more sizes of sheets, enhancing the productivity in more print cases.

As described above, according to Embodiment 4, the productivity can be enhanced while the damage to the fixing device and the occurrence of the poor fixing are prevented.

According to the present invention, the productivity can be enhanced while the damage to the fixing device and the occurrence of the poor fixing are prevented.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-006464, filed Jan. 18, 2019, which is hereby incorporated by reference herein in its entirety.

What is claimed is:

1. An image forming apparatus comprising:

an image forming unit configured to form a toner image on a recording material;

a fixing unit including a heater having at least a first heat generation member and a second heat generation member whose length in a longitudinal direction is shorter than a length of the first heat generation member in the longitudinal direction, and a third heat generation member whose length in a longitudinal direction is shorter than a length of the second heat generation member in the longitudinal direction, the fixing unit being configured to fix an unfixed toner image formed on the recording material by the image forming unit;

a switch unit configured to switch a power supply path so that electric power is enabled to supply to one of the first heat generation member and the second heat generation member of the heater;

a control unit, in a case where recording materials each having a first width and recording materials each having a second width shorter than the first width in the longitudinal direction are mixedly to be printed, configured to control switching of the power supply path by the switch unit based on a number of the recording materials having the second width to be continuously printed; and a substrate on which the first heat generation member, the second heat generation member, the third heat generation member and another of the first heat generation member are provided, wherein the first heat generation member is provided at one edge portion of the substrate in a width direction perpendicular to the longitudinal direction and the another of the first heat generation member is provided at another edge portion of the substrate in the width direction, and wherein the first heat generation member, the second heat generation member, the third heat generation member, and the another of the first heat generation member are provided in the width direction in that order.

2. An image forming apparatus according to claim 1, wherein the first width corresponds to the length of the first heat generation member in the longitudinal direction, wherein the second width corresponds to the length of the second heat generation member in the longitudinal direction, and wherein in a case where recording materials each having the first width and recording materials each having the second width in the longitudinal direction are mixedly to be printed, and when a number of the recording materials having the second width to be continuously printed is equal to or more than a predetermined number of sheets, the control unit performs a control to switch the power supply path to the second heat generation member.

3. An image forming apparatus according to claim 2, wherein the control unit performs a control to continue printing without switching by the switch unit in a case where the number of the recording materials having the second width to be continuously printed is less than the predetermined number of sheets, even in a case where the recording materials having the second width are continuously printed in a state where the power supply path is switched to the first heat generation member.

4. An image forming apparatus according to claim 2, wherein the control unit performs control to switch the power supply path to the first heat generation member using the switch unit in a case where the recording materials having the first width are printed after the recording materials having the second width in a state where the power supply path is switched to the second heat generation member.

5. An image forming apparatus according to claim 4, wherein the control unit performs control to switch the power supply path to the first heat generation member in advance by the switch unit, in a case where it is scheduled that the recording materials having the first width are to be printed after the recording materials having the second width in a state where the power supply path is switched to the second heat generation member, even while the recording materials having the second width are continuously printed.

6. An image forming apparatus according to claim 5, further comprising a detection unit configured to detect a temperature of a center portion and a temperature of an edge portion of the heater in the longitudinal direction, wherein the control unit performs a control to switch the power supply path to the first heat generation member by the switch unit at a timing when a difference between the temperature of the center portion and the temperature of the edge portion detected by the detection unit becomes equal to or more than a predetermined temperature difference while the recording materials having the second width are continuously printed in a state where the power supply path is switched to the second heat generation member.

7. An image forming apparatus according to claim 6, wherein the control unit performs control in which fixing processing by the fixing unit is performed after the temperature of the center portion and the temperature of the edge portion detected by the detection unit reach a target temperature.

8. An image forming apparatus according to claim 2, wherein in a case where recording materials having the first width and the recording materials having the second width are mixedly printed, when a first sheet to be printed has the second width and a number of the recording materials having the second width to be continuously printed is equal to or more than the predetermined number of sheets, the control unit performs control in which the switch unit switches the power supply path to the second heat generation member.

9. An image forming apparatus according to claim 8, wherein in a case where recording materials having the first width and the recording materials having the second width are mixedly printed, when a number of the recording materials having the second width to be continuously printed is less than the predetermined number of sheets even if a first sheet to be printed has the second width, the control unit performs control in which printing is continued without performing switching by the switch unit.

10. An image forming apparatus according to claim 1, further comprising a connecting unit configured to connect a line or cut off the line to supply electric power to one of the first heat generation member and the second heat generation member, wherein the control unit controls the connecting unit to cut off the line to supply the electric power to one of the first heat generation member and the second heat generation member before the switch unit switches the power supply path, and controls the connecting unit to connect the line to supply electric power to one of the first heat generation member and the second heat generation member after the switch unit switches the power supply path.

11. An image forming apparatus according to claim 1, further comprising:

a first contact electrically connected to one edge portions of the first heat generation member and the another of the first heat generation member;

a fourth contact electrically connected to another edge portions of the first heat generation member and the another of the first heat generation member, and one edge of the second heat generation member;

a second contact electrically connected to another edge portion of the second heat generation member and one edge portion of the third heat generation member; and a third contact electrically connected to another edge portion of the third heat generation member.

12. An image forming apparatus according to claim 1, further comprising:

a first connecting unit configured to connect or cut off a line to supply electric power to the first heat generation member; and a second connecting unit configured to connect or cut off a line to supply electric power to the second heat generation member, wherein the control unit controls one of the first connecting unit and the second connecting unit to cut off the line supply of electric power to one of the first heat generation member and the second heat generation member, respectively, the switch unit switches the power supply path, and controls one of the first connecting unit and the second connecting unit to connect the line to supply electric power to one of the first heat generation member and the second heat generation member, respectively, after the switch unit switches the power supply path.

13. An image forming apparatus according to claim 1, wherein the length of the first heat generation member in the longitudinal direction is a length corresponding to a width of a recording material having a largest width of recording materials printable by the image forming apparatus.

14. An image forming apparatus according to claim 1, further comprising:

a first rotary member configured to be heated by the heater; and a second rotary member forming a nip portion with the first rotary member.

15. An image forming apparatus according to claim 14, wherein the first rotary member is a film.

16. An image forming apparatus according to claim 15, wherein the heater is provided to be in contact with an inner surface of the film, and wherein the nip portion is formed through the film with the heater and the second rotary member.

17. An image forming apparatus comprising:

an image forming unit configured to form a toner image on a recording material;

a fixing unit including a heater having at least a first heat generation member and a second heat generation member whose length in a longitudinal direction is shorter than a length of the first heat generation member in the longitudinal direction, the fixing unit being configured to fix an unfixed toner image formed on the recording material by the image forming unit;

a switch unit configured to switch a power supply path so that electric power is enabled to supply to one of the first heat generation member and the second heat generation member of the heater;

a control unit, in a case where recording materials each having a first width and recording materials each having a second width shorter than the first width in the longitudinal direction are mixedly to be printed, configured to control switching of the power supply path by the switch unit based on a number of the recording materials having the second width to be continuously printed; and a detection unit configured to detect a temperature of a center portion and a temperature of an edge portion of the heater in the longitudinal direction, wherein the first width corresponds to the length of the first heat generation member in the longitudinal direction, wherein the second width corresponds to the length of the second heat generation member in the longitudinal direction, wherein in a case where recording materials each having the first width and recording materials each having the second width in the longitudinal direction are mixedly to be printed when a number of the recording materials having the second width to be continuously printed is equal to or more than a predetermined number of sheets, the control unit performs a control to switch the power supply path to the second heat generation member, wherein the control unit performs control to switch the power supply path to the first heat generation member using the switch unit in a case where the recording materials having the first width are printed after the recording materials having the second width in a state where the power supply path is switched to the second heat generation member, wherein the control unit performs control to switch the power supply path to the first heat generation member in advance by the switch unit, in a case where it is scheduled that the recording materials having the first width are to be printed after the recording materials having the second width in a state where the power supply path is switched to the second heat generation member, even while the recording materials having the second width are continuously printed, and wherein the control unit performs a control to switch the power supply path to the first heat generation member by the switch unit at a timing when a difference between the temperature of the center portion and the temperature of the edge portion detected by the detection unit becomes equal to or more than a predetermined temperature difference while the recording materials having the second width are continuously printed in a state where the power supply path is switched to the second heat generation member.

18. An image forming apparatus according to claim 17, wherein the control unit performs control in which fixing processing by the fixing unit is performed after the temperature of the center portion and the temperature of the edge portion detected by the detection unit reach a target temperature.

* * * * *